US011792594B2

(12) United States Patent
Bharitkar

(10) Patent No.: US 11,792,594 B2
(45) Date of Patent: Oct. 17, 2023

(54) SIMULTANEOUS DECONVOLUTION OF LOUDSPEAKER-ROOM IMPULSE RESPONSES WITH LINEARLY-OPTIMAL TECHNIQUES

(71) Applicant: Samsung Electronics Co., Ltd., Suwon-si (KR)

(72) Inventor: Sunil Bharitkar, Stevenson Ranch, CA (US)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 17/584,181

(22) Filed: Jan. 25, 2022

(65) Prior Publication Data

US 2023/0052010 A1 Feb. 16, 2023

Related U.S. Application Data

(60) Provisional application No. 63/227,024, filed on Jul. 29, 2021.

(51) Int. Cl.

| | |
|---|---|
| ***H04S 7/00*** | (2006.01) |
| ***H04R 5/02*** | (2006.01) |
| ***H04R 5/04*** | (2006.01) |
| ***H04S 3/00*** | (2006.01) |
| ***H04R 5/027*** | (2006.01) |

(52) U.S. Cl.

CPC ..... *H04S 7/301* (2013.01); *H04R 5/02* (2013.01); *H04R 5/027* (2013.01); *H04R 5/04* (2013.01); *H04S 3/008* (2013.01); *H04S 7/305* (2013.01); *H04S 2400/01* (2013.01); *H04S 2400/15* (2013.01)

(58) Field of Classification Search

None

See application file for complete search history.

(56) References Cited

U.S. PATENT DOCUMENTS

| | | | |
|---|---|---|---|
| 6,798,889 | B1 | 9/2004 | Dicker et al. |
| 9,215,542 | B2 | 12/2015 | Silzle et al. |
| 10,104,490 | B2 | 10/2018 | Family et al. |
| 10,924,874 | B2 | 2/2021 | Bonnick et al. |
| 2015/0230041 | A1 | 8/2015 | Fejzo et al. |
| 2018/0033449 | A1 | 2/2018 | Theverapperuma et al. |

(Continued)

OTHER PUBLICATIONS

International Search Report & Written Opinion dated Aug. 22, 2022 for International Application No. PCT/KR2022/007230 from the Korean Intellectual Property Office, pp. 1-9, Republic of Korea.

*Primary Examiner* — Kenny H Truong

(74) *Attorney, Agent, or Firm* — SHERMAN IP LLP; Kenneth L. Sherman; Hemavathy Perumal

(57) ABSTRACT

One embodiment provides a method comprising determining stimuli for simultaneously exciting a plurality of speakers within a spatial area. The method further comprises simultaneously exciting the plurality of speakers by providing the stimuli to the plurality of speakers at the same time for reproduction. The method further comprises recording, during the reproduction, one or more measurements of sound arriving at one or more microphones within the spatial area. The method further comprises simultaneously deconvolving a plurality of impulse responses of the plurality of speakers based on the stimuli and the one or more measurements.

20 Claims, 25 Drawing Sheets

(56) References Cited

U.S. PATENT DOCUMENTS

| | | | | |
|---|---|---|---|---|
| 2019/0028484 | A1 | 1/2019 | Truong | |
| 2019/0075414 | A1 | 3/2019 | Bush | |
| 2019/0320275 | A1 | 10/2019 | Audfray | |
| 2020/0052671 | A1 | 2/2020 | Kim et al. | |
| 2020/0396559 | A1 | 12/2020 | Crockett et al. | |
| 2021/0116555 | A1 | 4/2021 | Zacca | |
| 2022/0116704 | A1* | 4/2022 | Barnhill ..... | H04S 7/301 |

* cited by examiner

300

400

430

700

SIMULTANEOUS DECONVOLUTION OF LOUDSPEAKER-ROOM IMPULSE RESPONSES WITH LINEARLY-OPTIMAL TECHNIQUES

CROSS-REFERENCE TO RELATED APPLICATIONS

This application claims the priority benefit of U.S. Provisional Patent Application Ser. No. 63/227,024, filed Jul. 29, 2021, all incorporated herein by reference in their entirety.

TECHNICAL FIELD

One or more embodiments generally relate to loudspeaker-room equalization, in particular, a method and system for simultaneous deconvolution of loudspeaker-room impulse responses with linearly-optimal techniques.

BACKGROUND

Loudspeaker-room equalization is essential for creating high-quality spatial and immersive audio for consumer home-theater (e.g., soundbar speakers, television (TV) speakers, home theater in a box (HTIB) speakers, etc.) and large environments (movie theaters, live venues, etc.). Loudspeaker-room equalization involves performing an in-situ, or in-room, measurement by exciting one or more loudspeakers within a room with an excitation signal (i.e., stimuli), estimating loudspeaker-room impulse responses based on the measurement, and designing equalization filters for each loudspeaker based on the impulse responses. The excitation signal may be programmed in a digital signal processing (DSP) or central processing unit (CPU) of an electronic device. Alternatively, the excitation signal may be retrieved from a remote server or a client before being delivered to the loudspeakers. Examples of a stimuli include, but are not limited to, Maximum Length Sequence (MLS), log-sweep, multi-tone, or shaped stimuli (e.g., pink-noise).

SUMMARY

One embodiment provides a method comprising determining stimuli for simultaneously exciting a plurality of speakers within a spatial area. The method further comprises simultaneously exciting the plurality of speakers by providing the stimuli to the plurality of speakers at the same time for reproduction. The method further comprises recording, during the reproduction, one or more measurements of sound arriving at one or more microphones within the spatial area. The method further comprises simultaneously deconvolving a plurality of impulse responses of the plurality of speakers based on the stimuli and the one or more measurements.

Another embodiment provides a system comprising at least one processor and a non-transitory processor-readable memory device storing instructions that when executed by the at least one processor causes the at least one processor to perform operations. The operations include determining stimuli for simultaneously exciting a plurality of speakers within a spatial area. The operations further include simultaneously exciting the plurality of speakers by providing the stimuli to the plurality of speakers at the same time for reproduction. The operations further include recording, during the reproduction, one or more measurements of sound arriving at one or more microphones within the spatial area. The operations further include simultaneously deconvolving a plurality of impulse responses of the plurality of speakers based on the stimuli and the one or more measurements.

One embodiment provides a non-transitory processor-readable medium that includes a program that when executed by a processor performs a method. The method comprises determining stimuli for simultaneously exciting a plurality of speakers within a spatial area. The method further comprises simultaneously exciting the plurality of speakers by providing the stimuli to the plurality of speakers at the same time for reproduction. The method further comprises recording, during the reproduction, one or more measurements of sound arriving at one or more microphones within the spatial area. The method further comprises simultaneously deconvolving a plurality of impulse responses of the plurality of speakers based on the stimuli and the one or more measurements.

These and other aspects and advantages of one or more embodiments will become apparent from the following detailed description, which, when taken in conjunction with the drawings, illustrate by way of example the principles of the one or more embodiments.

BRIEF DESCRIPTION OF THE DRAWINGS

For a fuller understanding of the nature and advantages of the embodiments, as well as a preferred mode of use, reference should be made to the following detailed description read in conjunction with the accompanying drawings, in which.

DETAILED DESCRIPTION

Figure 1:
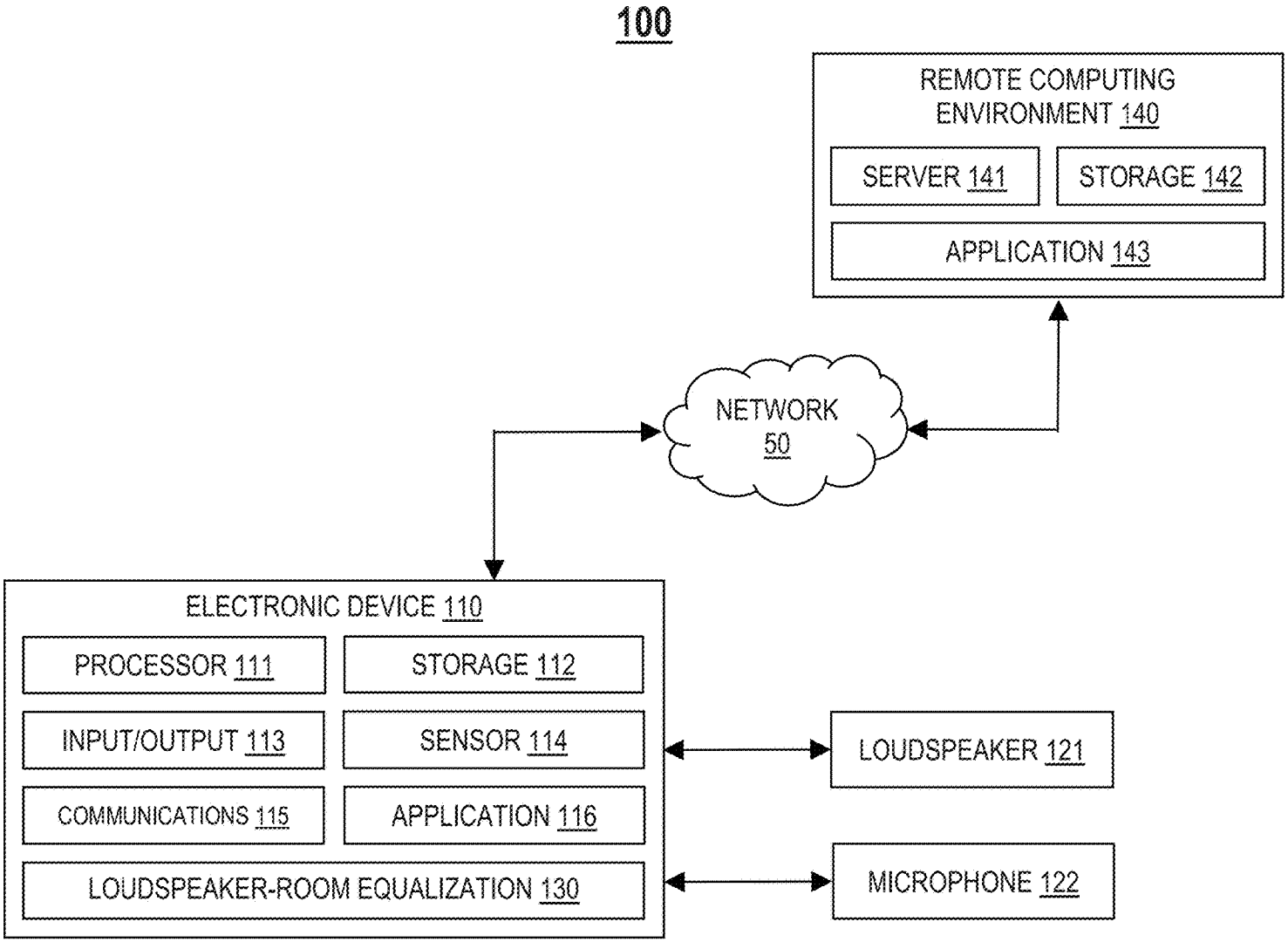
FIG. 1 is an example computing architecture for implementing loudspeaker-room equalization with simultaneous deconvolution of loudspeaker-room impulse responses, in one or more embodiments.

The following description is made for the purpose of illustrating the general principles of one or more embodiments and is not meant to limit the inventive concepts claimed herein. Further, particular features described herein can be used in combination with other described features in each of the various possible combinations and permutations. Unless otherwise specifically defined herein, all terms are to be given their broadest possible interpretation including meanings implied from the specification as well as meanings understood by those skilled in the art and/or as defined in dictionaries, treatises, etc.

One or more embodiments generally relate to loudspeaker-room equalization, in particular, a method and system for simultaneous deconvolution of loudspeaker-room impulse responses with linearly-optimal techniques. One embodiment provides a method comprising determining stimuli for simultaneously exciting a plurality of speakers within a spatial area. The method further comprises simultaneously exciting the plurality of speakers by providing the stimuli to the plurality of speakers at the same time for reproduction. The method further comprises recording, during the reproduction, one or more measurements of sound arriving at one or more microphones within the spatial area. The method further comprises simultaneously deconvolving a plurality of impulse responses of the plurality of speakers based on the stimuli and the one or more measurements.

Another embodiment provides a system comprising at least one processor and a non-transitory processor-readable memory device storing instructions that when executed by the at least one processor causes the at least one processor to perform operations. The operations include determining stimuli for simultaneously exciting a plurality of speakers within a spatial area. The operations further include simultaneously exciting the plurality of speakers by providing the stimuli to the plurality of speakers at the same time for reproduction. The operations further include recording, during the reproduction, one or more measurements of sound arriving at one or more microphones within the spatial area. The operations further include simultaneously deconvolving a plurality of impulse responses of the plurality of speakers based on the stimuli and the one or more measurements.

One embodiment provides a non-transitory processor-readable medium that includes a program that when executed by a processor performs a method. The method comprises determining stimuli for simultaneously exciting a plurality of speakers within a spatial area. The method further comprises simultaneously exciting the plurality of speakers by providing the stimuli to the plurality of speakers at the same time for reproduction. The method further comprises recording, during the reproduction, one or more measurements of sound arriving at one or more microphones within the spatial area. The method further comprises simultaneously deconvolving a plurality of impulse responses of the plurality of speakers based on the stimuli and the one or more measurements.

For expository purposes, the terms "speakers" and "loudspeakers" are used interchangeably in this specification.

Conventional approaches for loudspeaker-room equalization involve sequentially exciting one loudspeaker within a room one at a time with a stimulus signal, and measuring a loudspeaker-room response of each loudspeaker using one or more in-situ, or in-room, microphones (i.e., measurement microphones). Each microphone has a microphone position representing a position of the microphone within the room. Loudspeaker-room response of each loudspeaker within the room is measured at one or more microphone positions sequentially. For example, a first loudspeaker within the room is excited with a stimulus signal and a loudspeaker-room response of the first loudspeaker is extracted from a first measurement, a second loudspeaker within the room is then excited with the stimulus signal and a loudspeaker-room response of the second loudspeaker is extracted from a second measurement, and this continues until all loudspeakers within the room have been sequentially excited with the stimulus signal and measured.

A stimulus signal may be deterministic (e.g., pink-noise, logarithmic sweep (log-sweep), multi-tone, or maximum length sequences (MLS)) or stochastic (e.g., white-noise). A loudspeaker-room response may be represented as an impulse response (depicting direct sound, early reflections, and late reflections or reverberations) that includes information indicative of a time-delay for direct sound to arrive at a measurement microphone. A loudspeaker-room response may also be represented as a magnitude response (in the frequency domain).

For expository purposes, the terms "listening position" and "microphone position" are used interchangeably in this specification.

Typically, repeated measurements, and averaging, per loudspeaker, are done per listening position (i.e., multiple listening positions spatial averaging) to obtain a high signal-to-noise ratio (SNR) in the impulse response. With these conventional approaches, as a number of loudspeakers and positions of the loudspeakers increase, in addition to repeated measurements for averaging, the amount of time required to measure loudspeaker-room responses (i.e., measurement time) will increase significantly based on a length of the stimulus signal. The length of the stimulus signal and the measurement time (when there is silence and no stimulus is present) is a function of an amount of low-frequency reverberation that needs to be captured for high resolution analysis in the low-frequency region of human hearing. In consumer environments involving consumer electronic devices, typical measurement and deconvolution time per loudspeaker, per listening position be at least as long as 5 seconds, whereas in professional venues such as movie theaters and live venues, typical measurement time per loudspeaker may be significantly increased by a factor of 3 or higher. For example, with a 7.1.4 loudspeaker setup and 10 averages per listening position, the measurement time may be at least as long as 600 seconds (10 minutes) per listening position. Even without averaging, measurement time per listening position may be as long as a minute in a consumer environment. This tradeoff in time with equalization also impacts any factory calibration of soundbar speakers. Measurement time and calibration time is further increased in professional venues (e.g., movie theaters) due to use of larger loudspeaker arrays.

One or more embodiments provide a method and system for simultaneously exciting all loudspeakers within a room (or another space) with a stimuli or a combination of different stimuli, and simultaneously extracting loudspeaker-room impulse responses (i.e., magnitude and phase) of all the loudspeakers from one or more measurements (i.e., recordings) recorded via one or more measurement microphones. The loudspeaker-room impulse responses of all the loudspeakers within the room are measured at one or more microphone positions (of the one or more measurement microphones) simultaneously (i.e., in parallel).

The loudspeakers within the room may include, but are not limited to, television (TV) speakers, discrete home theater in a box (HTIB) speakers, soundbar speakers, etc. The measurements comprise a capture of signals emanating at the same time from all the loudspeakers. By simultaneously exciting all the loudspeakers at the same time, significant measurement time is avoided, thereby saving time and providing a low barrier for use in consumer environments.

In one embodiment, excitation signals (i.e., the stimuli or the combination of different stimuli) may be generated by a distributed digital signal processing (DSP) or central processing unit (CPU) of the loudspeakers, a centralized DSP/CPU of an electronic device (e.g., TV, soundbar, HTIB), a centralized DSP of a loudspeaker, or retrieved from a local/remote server before being delivered to the loudspeakers at the same time for reproduction.

In one embodiment, a simultaneous extraction routine for simultaneously extracting the loudspeaker-room impulse responses may be programmed on the distributed DSP/CPU of the loudspeakers, the centralized DSP/CPU of the electronic device (e.g., TV, soundbar, HTIB), the centralized DSP of a loudspeaker, a CPU of a mobile device (e.g., a smart phone) separate from the electronic device, or on the local/remote server.

In one embodiment, the measurement microphones may be on individual loudspeakers distributed within the room, included with the electronic device (e.g., TV, soundbar, HTIB), or included in the mobile device (e.g., a smart phone). For example, a mobile application executing or operating on the mobile device invokes a measurement microphone of the mobile device to record at a microphone position of the measurement microphone and send a measurement (i.e., recording) to a local DSP/CPU of the mobile device or to a remote server via Wi-Fi.

In one embodiment, the loudspeaker-room impulse responses may be estimated by the DSP of the electronic device (e.g., TV, soundbar, HTIB) or on the remote server, and equalization filters designed for each loudspeaker may be immediately programmed on a DSP of the loudspeaker.

One or more embodiments are extendable to simultaneously exciting all loudspeakers within a room (or another space) and extracting accurate impulse responses from multiple measurements (i.e., recordings) recorded via one or more measurement microphones.

In one embodiment, arbitrary stimuli (including shaped versions of the stimuli) are used, resulting in pleasant-sounding or musical-like excitation/stimulus signals to simultaneously excite all the loudspeakers within the room.

In one embodiment, excitation signals may be circularly rotated while allowing capture of reverberation (e.g., low-frequency reverberation) of an arbitrary duration. For example, if the loudspeaker-room impulse responses do not decay to noise-floor, a circular shift (time-offset) between stimuli may be increased.

In one embodiment, an extraction algorithm applied to extract the loudspeaker-room impulse responses may be customized based on the stimuli or the combination of different stimuli used to simultaneously excite all the loudspeakers within the room.

FIG. 1 is an example computing architecture 100 for implementing loudspeaker-room equalization with simultaneous deconvolution of loudspeaker-room impulse responses, in one or more embodiments. The computing architecture 100 comprises an electronic device 110 including computing resources, such as one or more processor units 111 and one or more storage units 112. One or more applications may execute/operate on the electronic device 110 utilizing the computing resources of the electronic device 110.

Examples of an electronic device 110 include, but are not limited to, a television (TV), an audio or sound system (e.g., a soundbar, a HTIB, etc.), a smart appliance (e.g., a smart TV, etc.), a mobile electronic device (e.g., a smart phone, a laptop, a tablet, etc.), a wearable device (e.g., a smart watch, a smart band, a head-mounted display, smart glasses, etc.), a receiver, a gaming console, a video camera, a media playback device (e.g., a DVD player), a set-top box, an Internet of Things (IoT) device, a cable box, a satellite receiver, etc.

In one embodiment, the electronic device 110 comprises one or more input/output (I/O) units 113 integrated in or coupled to the electronic device 110. In one embodiment, the one or more I/O units 113 include, but are not limited to, a physical user interface (PUI) and/or a graphical user interface (GUI), such as a keyboard, a keypad, a touch interface, a touch screen, a knob, a button, a display screen, etc. In one embodiment, a user can utilize at least one I/O unit 113 to configure one or more user preferences, configure one or more parameters, provide user input, etc.

In one embodiment, the electronic device 110 comprises one or more sensor units 114 integrated in or coupled to the electronic device 110. In one embodiment, the one or more other sensor units 114 include, but are not limited to, a camera, a GPS, a motion sensor, etc.

In one embodiment, the computing architecture 100 comprises one or more in-situ, or in-room, loudspeakers 121 configured to reproduce audio/sounds. The one or more loudspeakers 121 are physically located/positioned within a spatial area, such as a room or another space (e.g., inside a vehicle). In one embodiment, the one or more loudspeakers 121 are integrated in the electronic device 110 (i.e., built-in loudspeakers). In another embodiment, the one or more loudspeakers 121 are connected to the electronic device 110 (e.g., via a wired or wireless connection).

In one embodiment, the computing architecture 100 comprises one or more in-situ, or in-room, microphones (i.e., measurement microphones) 122 configured to record audio/sounds. The one or more microphones 122 are physically located/positioned within the same spatial area (e.g., same room or same other space) as the one or more loudspeakers 121. In one embodiment, the one or more microphones 122 may be on the one or more loudspeakers 121, included with the electronic device 110 (i.e., built-in microphones), or included in a mobile device (e.g., a smart phone). In one embodiment, the one or more microphones 122 are connected to the electronic device 110 (e.g., via a wired or wireless connection). Each microphone 122 provides an audio channel.

In one embodiment, the one or more applications on the electronic device 110 include a loudspeaker-room equalization system 130 that provides measurement and loudspeaker-room equalization/calibration utilizing the one or more loudspeakers 121 and the one or more microphones 122. The loudspeaker-room equalization system 130 is configured for: (1) simultaneously exciting all the loudspeakers 121 within the room (or another space, such as inside a vehicle) with a stimuli or a combination of different stimuli, and (2) simultaneously extracting loudspeaker-room impulse responses (i.e., magnitude and phase) of all the loudspeakers 121 from one or more measurements (i.e., recordings) recorded via the one or more microphones 122. The loudspeaker-room impulse responses of all the loudspeakers 121 are measured at one or more microphone positions of the one or more microphones 122 simultaneously (i.e., in parallel). As described in detail later herein, the loudspeaker-room equalization system 130 performs simultaneous deconvolution of the loudspeaker-room impulse responses by applying one or more linearly-optimal algorithms/techniques.

Unlike conventional approaches of sequential measurements of loudspeaker-room responses, the loudspeaker-room equalization system 130 automatically determines all the loudspeaker-room impulse responses in a single step, thereby significantly saving measurement time while giving accurate estimates of the loudspeaker-room impulse responses. In one embodiment, the loudspeaker-room equalization system 130 provides equalization/calibration of all the loudspeakers 121 within the room (or another space). The loudspeaker-room impulse responses may be used to create high-quality immersive spatial audio experiences on TVs, soundbars, and mobile devices.

In one embodiment, the one or more applications on the electronic device 110 may further include one or more software mobile applications 116 loaded onto or downloaded to the electronic device 110, such as an audio streaming application, a video streaming application, etc. A software mobile application 116 on the electronic device 110 may exchange data with the loudspeaker-room equalization system 130.

In one embodiment, the electronic device 110 comprises a communications unit 115 configured to exchange data with a remote computing environment, such as a remote computing environment 140 over a communications network/connection 50 (e.g., a wireless connection such as a Wi-Fi connection or a cellular data connection, a wired connection, or a combination of the two). The communications unit 115 may comprise any suitable communications circuitry operative to connect to a communications network and to exchange communications operations and media between the electronic device 110 and other devices connected to the same communications network 50. The communications unit 115 may be operative to interface with a communications network using any suitable communications protocol such as, for example, Wi-Fi (e.g., an IEEE 802.11 protocol), Bluetooth®, high frequency systems (e.g., 900 MHz, 2.4 GHz, and 5.6 GHz communication systems), infrared, GSM, GSM plus EDGE, CDMA, quadband, and other cellular protocols, VOIP, TCP-IP, or any other suitable protocol.

In one embodiment, the remote computing environment 140 includes computing resources, such as one or more servers 141 and one or more storage units 142. One or more applications 143 that provide higher-level services may execute/operate on the remote computing environment 140 utilizing the computing resources of the remote computing environment 140.

In one embodiment, the remote computing environment 140 provides an online platform for hosting one or more online services (e.g., an audio streaming service, a video streaming service, etc.) and/or distributing one or more applications. For example, the loudspeaker-room equalization system 130 may be loaded onto or downloaded to the electronic device 110 from the remote computing environment 140 that maintains and distributes updates for the system 130. As another example, a remote computing environment 140 may comprise a cloud computing environment providing shared pools of configurable computing system resources and higher-level services.

In one embodiment, the loudspeaker-room equalization system 130 is integrated into, or implemented as part of, a consumer home-theater environment, such as a TV, a soundbar, or a HTIB. In one embodiment, the loudspeaker-room equalization system 200 (FIG. 2) may be used for in-situ, or factory, measurement and equalization of all speakers within the environment simultaneously in a very short time.

In one embodiment, the loudspeaker-room equalization system 130 is integrated into, or implemented as part of, a professional venue, such as a cinema, a movie theatre, or a live venue. In one embodiment, the loudspeaker-room equalization system 200 may be used for measuring and calibrating all speakers within the professional venue in a very short time.

In one embodiment, the loudspeaker-room equalization system 130 is integrated into, or implemented as part of, an automotive receiver of a vehicle, such as a car. In one embodiment, the loudspeaker-room equalization system 200 may be used for measuring and tuning automotive acoustics very fast by exciting all loudspeakers within the vehicle at the same time.

In one embodiment, the loudspeaker-room equalization system 200 may be used for measuring head-related transfer functions, include measuring human ear responses at various angles of multiple speakers arranged in a hemispherical arrangement. These responses may be used to create high-quality immersive spatial audio experiences on TVs, soundbars, and mobile devices.

In one embodiment, the loudspeaker-room equalization system 200 may be readily adapted to work on local devices (e.g., DSP with microphones in TVs or soundbars, or with smart phones and its mobile apps) or on a cloud (e.g., with smart phones, its mobile apps, and Wi-Fi connected speakers).

Figure 2:
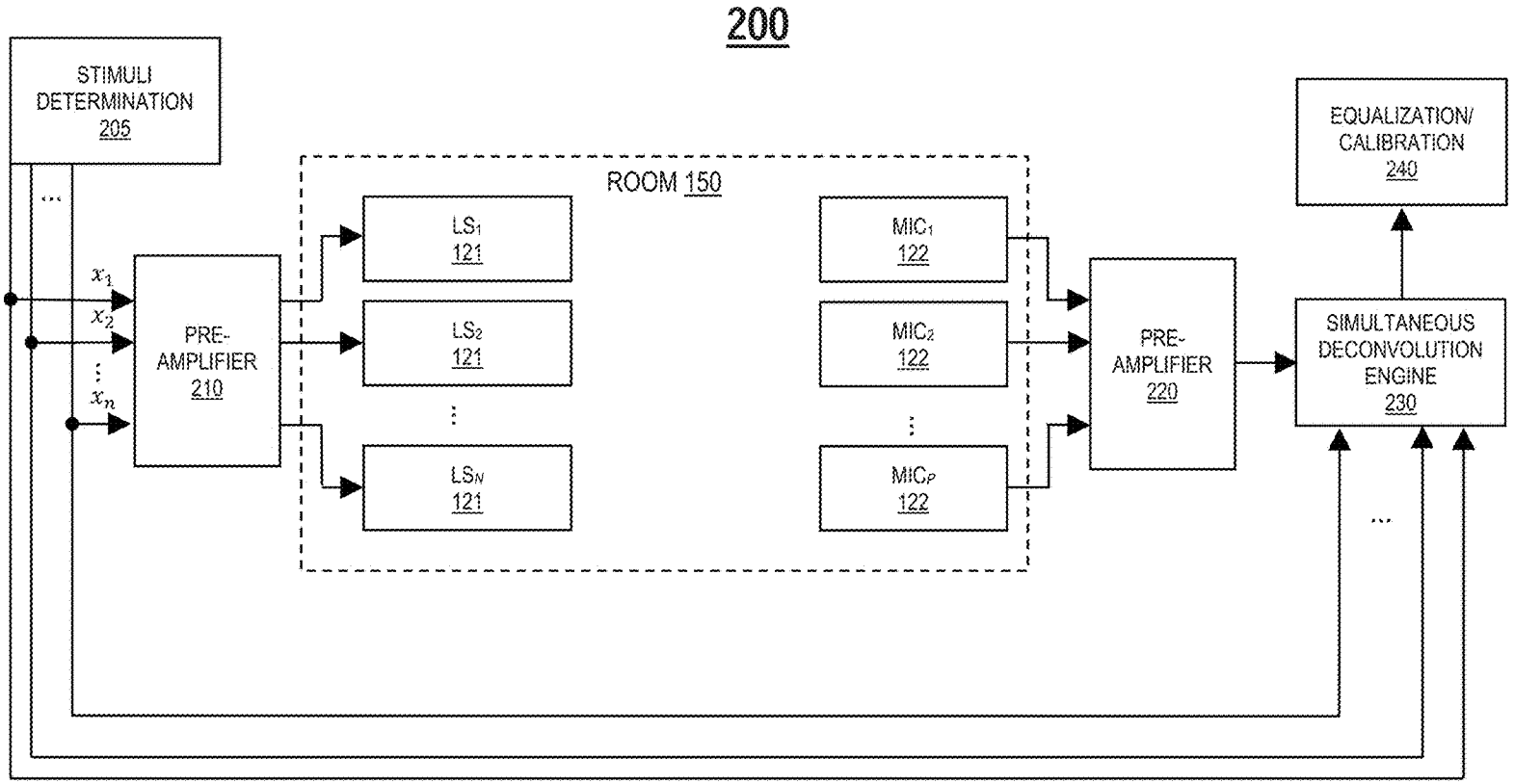
FIG. 2 illustrates an example on-device loudspeaker-room equalization system, in one or more embodiments.

FIG. 2 illustrates an example on-device loudspeaker-room equalization system 200, in one or more embodiments. In one embodiment, the loudspeaker-room equalization system 130 in FIG. 1 is implemented as the loudspeaker-room equalization system 200. Let N generally denote a number of in-situ, or in-room, loudspeakers 121, wherein N is a positive integer. The N loudspeakers include a first loudspeaker $LS_1$, a second loudspeaker $LS_2$, . . . , and a $N^{th}$ loudspeaker $LS_N$. The N loudspeakers provide N loudspeaker channels (each loudspeaker 121 provides a loudspeaker channel).

Let P generally denote a number of in-situ, or in-room, microphones (i.e., measurement microphones) 122, wherein P is a positive integer. The P microphones include a first microphone $MIC_1$, a second microphone $MIC_2$, . . . , and a $P^{th}$ microphone $MIC_P$. The N loudspeakers and the P microphones are physically located/positioned within a room 150 (or another space, such as inside a vehicle).

Let i generally denote a loudspeaker/loudspeaker channel of the N loudspeakers/loudspeaker channels, wherein $i \in [1, N]$. Let $x_i$ generally denote an excitation/stimulus signal delivered to loudspeaker i for reproduction. Let $h_{i,p}(n)$ generally denote a loudspeaker-room impulse response of loudspeaker i measured at a location of microphone p within the room 150, wherein $p \in [1, P]$, and $h_{i,p}(n) \leftrightarrow H_{i,p}(e^{pw})$.

In one embodiment, the loudspeaker-room equalization system 200 comprises a stimuli determination unit 205 configured to determine and generate stimuli, or a combination of stimuli, for simultaneously exciting all the N loudspeakers. In one embodiment, the stimuli, or combination of stimuli, includes N stimulus signals (i.e., excitation signals) $x_1$, $x_2$, . . . , and $x_N$ for simultaneously exciting the N loudspeakers $LS_1$, $LS_2$, . . . , and $LS_N$, respectively. In one embodiment, each of the N stimulus signals starts at a different initial point of the stimuli. In one embodiment, each of the N stimulus signals has the same duration.

In one embodiment, the stimuli determination unit 205 is integrated into, or implemented as part of, a distributed DSP/CPU of the loudspeakers 121, a centralized DSP/CPU of an electronic device (e.g., an electronic device 110 such as a TV), a centralized DSP of a loudspeaker 121, or a local/remote server (e.g., remote computing environment 140).

In one embodiment, the loudspeaker-room equalization system 200 comprises a first pre-amplifier 210 configured to: (1) receive stimuli, or a combination of stimuli, that includes N stimulus signals $x_1$, $x_2$, . . . , and $x_N$ (e.g., from the stimuli determination unit 205), (2) amplify/boost the N stimulus signals, and (3) deliver the N stimulus signals $x_2$, . . . , and $x_N$ to the N loudspeakers $LS_1$, $LS_2$, . . . , and $LS_N$, respectively, at the same time for playback to simultaneously excite all the N loudspeakers 121 within the room 150. Specifically, each loudspeaker i reproduces a stimulus signal $x_i$ in response to receiving the stimulus signal $x_i$ from the first pre-amplifier 210.

In one embodiment, the P microphones 122 $MIC_1$, $MIC_2$, . . . , and $MIC_P$ simultaneously measure/record audio/sound arriving at the P microphones $MIC_1$, $MIC_2$, . . . , and $MIC_P$, respectively, resulting in P measurements/recordings measured/recorded at P microphone positions (i.e., microphone positions of the P microphones).

In one embodiment, the loudspeaker-room equalization system 200 comprises a second pre-amplifier 220 configured to: (1) receive P measurements/recordings (e.g., from the P microphones 122), and (2) amplify/boost the P measurements/recordings.

In one embodiment, the loudspeaker-room equalization system 200 comprises a simultaneous deconvolution engine 230 configured to: (1) receive P measurements/recordings (e.g., from the second pre-amplifier 220), (2) receive stimuli, or a combination of stimuli, that includes N stimulus signals (e.g., from the stimuli determination unit 205), and (3) for each of the P microphone positions, perform simultaneous deconvolution to simultaneously deconvolve N loudspeaker-room impulse responses using a single recording from the P measurements/recordings, wherein the single recording is measured/recorded at the microphone position after all the N loudspeakers 121 are simultaneously excited with the stimuli or the combination of stimuli. The simultaneous deconvolution includes applying an extraction algorithm to the P measurements/recordings to simultaneously extract the N loudspeaker-room impulse responses (i.e., simultaneous extraction routine), wherein the extraction algorithm is based on the N stimulus signals. The N loudspeaker-room impulse responses include an impulse response of each of the N loudspeakers 121.

Therefore, the loudspeaker-room equalization system 200 performs a measurement process that involves in-situ, or in-room, measurement by simultaneously exciting all the N loudspeakers 121 within the room 150 with a stimuli (or combination of stimuli), and estimating the N loudspeaker-room impulse responses based on the stimuli and the P measurements/recordings. All the N loudspeakers 121 are playing (simultaneously excited) during the measurement process. For each loudspeaker i of the N loudspeakers 121, the measurement process involves the first pre-amplifier 210 providing, for playback at the loudspeaker i, a different initial point of the stimuli, and the simultaneous deconvolution engine 230 processing the playback at the loudspeaker i based on the different initial point of the stimuli. In one embodiment, the playback at each loudspeaker i has the same duration (i.e., each of the N stimulus signals has the same duration).

In one embodiment, the simultaneous deconvolution engine 230 is integrated into, or implemented as part of, a distributed DSP/CPU of the loudspeakers 121, a centralized DSP/CPU of an electronic device (e.g., an electronic device 110 such as a TV), a CPU of a mobile device (e.g., an electronic device 110 such as a smart phone), a centralized DSP of a loudspeaker 121, or a local/remote server (e.g., remote computing environment 140).

To simultaneously deconvolve N loudspeaker-room impulse responses, the simultaneous deconvolution engine 230 applies one or more linearly-optimal techniques. In one embodiment, the simultaneous deconvolution engine 230 applies one or more cross-correlating techniques to simultaneously deconvolve the N loudspeaker-room impulse responses. For example, in one embodiment, N stimulus signals (generated via the stimuli determination unit 205) must satisfy a Kronecker-delta cross-correlation after a circular shift of M samples (i.e., the stimuli is continuous and circular). In one embodiment, for two stimulus signals $x_i$ and $x_j$ to be reproduced by two distinct loudspeakers i and j within the room 150, a modulo cross-correlation between the stimulus signals $x_i$ and $x_i$ must satisfy a condition expressed in accordance with equations (1)-(2) provided below:

$$x_j(n)=x_i(n)\mathrm{mod}(jM) \quad (1), \text{ and}$$

$$\rho(x_i,x_j)=E\{x_i(n)x_j(n)\}=\delta(n-jM) \quad (2),$$

wherein $j \in [1, N-1]$, and E denotes a statistical expectation. In one embodiment, time-domain operations may be replaced with equivalent frequency-domain operations, using Fast Fourier transforms, to improve compute efficiency.

In one embodiment, stimuli (generated via the stimuli determination unit 205) is continuous and circularly rotated to allow capture of reverberation (e.g., low-frequency reverberation) of an arbitrary duration. For example, in one embodiment, an amount of circular shift based on M is set to ensure that a low-frequency reverberation tail duration is captured reliably in an impulse response.

Let y(n) generally denote a measurement/recording. Let $h_1(n)$ generally denote a true (i.e., actual) impulse response of loudspeaker i. A measurement/recording y(n) is expressed in accordance with equation (3) provided below:

$$y(n)=\Sigma_{i=1}^{N}x_i(n)\circledast h_i(n) \quad (3).$$

In one embodiment, as part of the simultaneous deconvolution, the simultaneous deconvolution engine 230 is configured to estimate an impulse response of each of the N loudspeakers 121. Let $\hat{h}_j$ (n) generally denote an estimated impulse response of loudspeaker j. In one embodiment, the simultaneous deconvolution engine 230 determines an estimated impulse response $\hat{h}_j$ (n) of loudspeaker j in accordance with equation (4) provided below:

$$\hat{h}_j(n)=\rho_{(x_j(n),y(n))} \quad (4).$$

Let $e_i(n)$ generally denote a reconstruction error representing a difference between a true impulse response $h_i(n)$ of loudspeaker i and an estimated impulse response $\hat{h}_i$ (n) of loudspeaker i. A reconstruction error $e_i(n)$ is expressed in accordance with equation (5) provided below:

$$e_i(n)=h_i(n)-\hat{h}_i(n) \quad (5).$$

In one embodiment, the loudspeaker-room equalization system 200 comprises an equalization/calibration unit 240 configured to: (1) receive N loudspeaker-room impulse responses, and (2) perform equalization/calibration of all the N loudspeakers 121 within the room 150 based on the N loudspeaker-room impulse responses. For example, the equalization/calibration may involve computing one or more equalization filters that are immediately programmed onto a DSP (e.g., a DSP of a loudspeaker 121). The equalization/calibration facilitates creating a high-quality immersive spatial audio experience for a listener/user (e.g., within the room 150 or within proximity of the N loudspeakers 121).

In one embodiment, the loudspeaker-room equalization system 200 simultaneously excites all the N loudspeakers 121 within the room 150 with an MLS stimuli or a combination of MLS stimuli. In one embodiment, to simultaneously deconvolve the N loudspeaker-room impulse responses, each MLS stimulus signal generated (via the stimuli determination unit 205) must satisfy the condition represented by equations (1)-(2) provided above. Each MLS stimulus signal is of order k, wherein k is a positive integer.

Figure 3A:
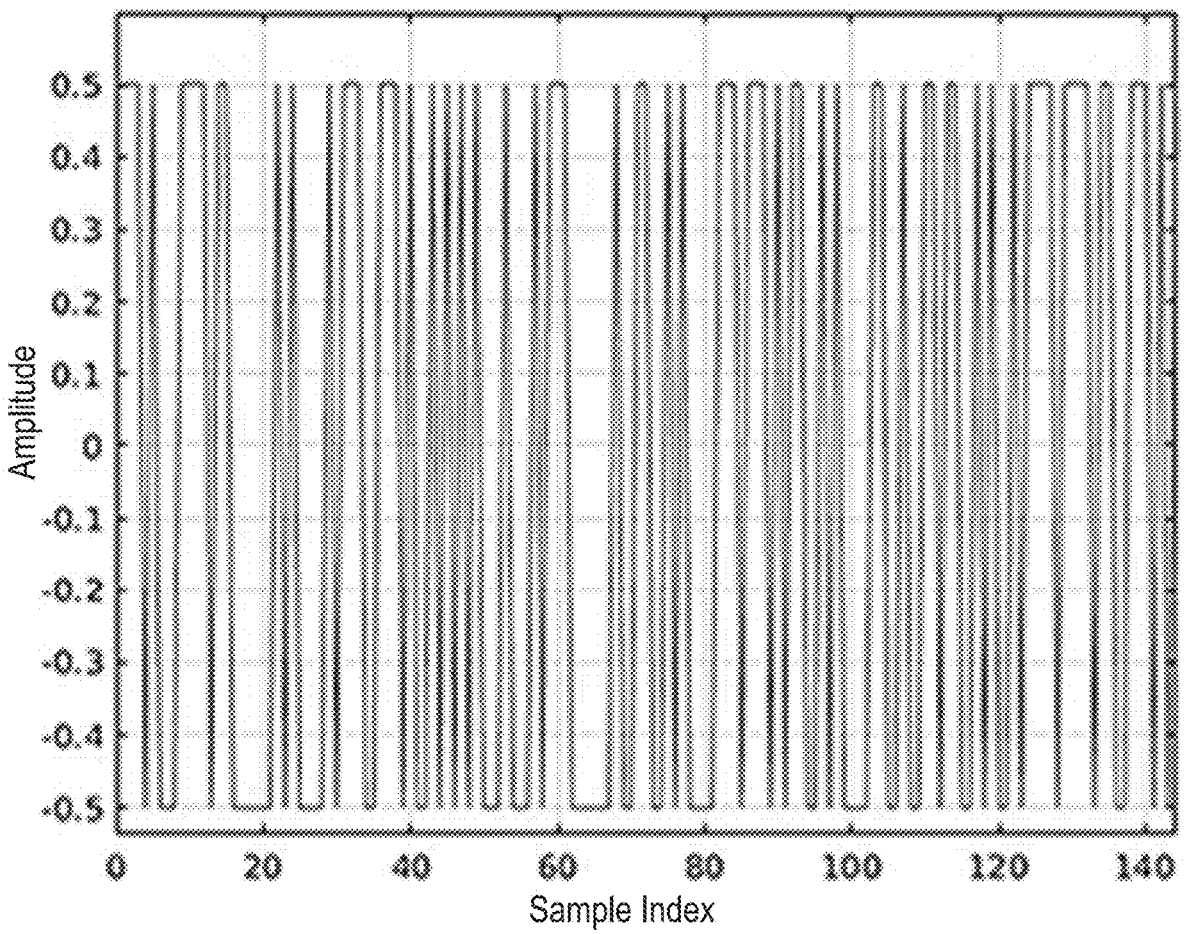
FIG. 3A illustrates a zoomed-in plot of an example base Maximum Length Sequence (MLS), in one or more embodiments.
Figure 3B:
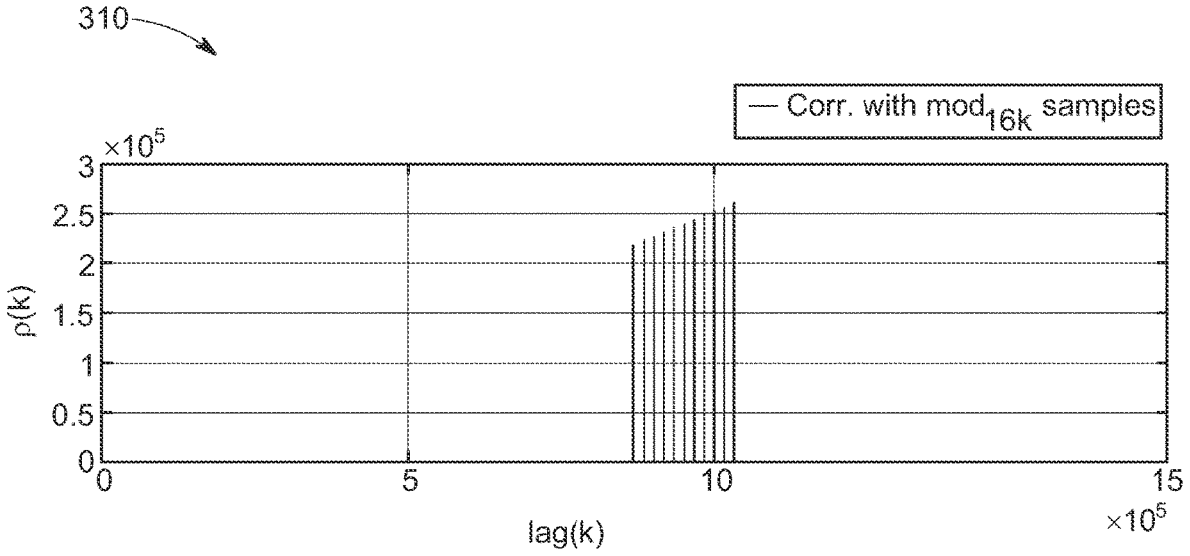
FIG. 3B illustrates a plot of an example windowed cross-correlation of 11 circularly-shifted sequences from the base MLS of FIG. 3A, in one or more embodiments.
Figure 3C:
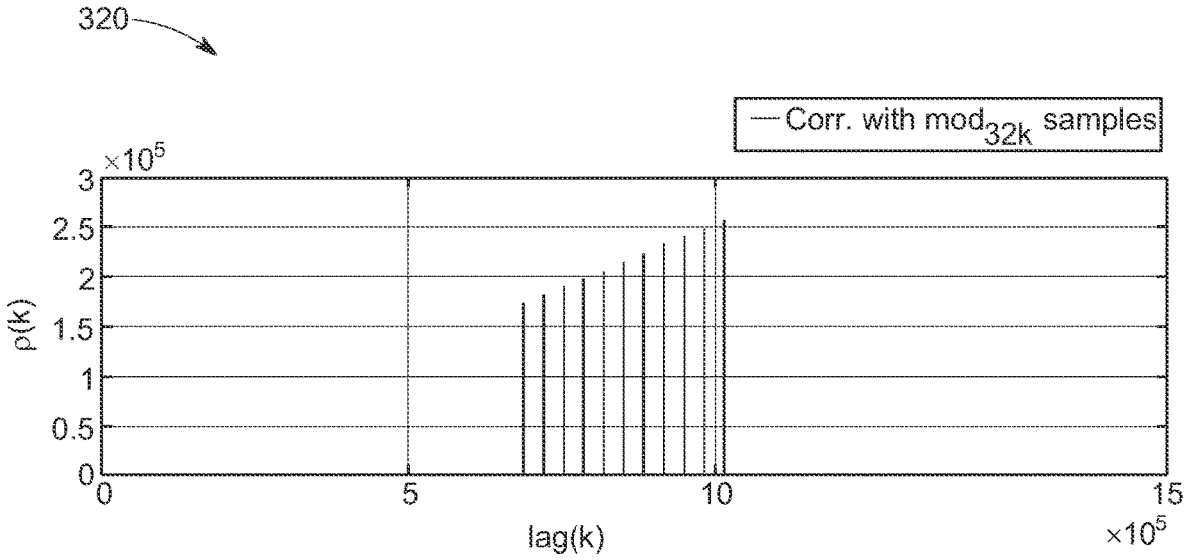
FIG. 3C illustrates a plot of an example windowed cross-correlation of another 11 circularly-shifted sequences from the base MLS of FIG. 3A, in one or more embodiments.

For FIGS. 3A-3C, assume an 11-loudspeaker setup (e.g., a 7.1.4 loudspeaker setup) comprising 11 distinct loudspeakers providing 11 loudspeaker channels. FIG. 3A illustrates a zoomed-in plot 300 of an example base MLS, in one or more embodiments. A horizontal axis of the plot 300 represents sample index (i.e., index of samples). A vertical axis of the plot 300 represents amplitude. The base MLS is of order 20 (i.e., k=20).

FIG. 3B illustrates a plot 310 of an example windowed cross-correlation of 11 circularly-shifted sequences from the base MLS of FIG. 3A, in one or more embodiments. The 11 circularly-shifted sequences are MLS stimulus signals resulting from a modulo M shift of samples of the base MLS of FIG. 3A, wherein M=16,384. In one embodiment, the loudspeaker-room equalization system 200 simultaneously excites the 11 distinct loudspeakers utilizing a continuous and circular stimuli that includes the 11 circularly-shifted sequences (generated via the stimuli determination unit 205).

FIG. 3C illustrates a plot 320 of an example windowed cross-correlation of another 11 circularly-shifted sequences from the base MLS of FIG. 3A, in one or more embodiments. The other 11 circularly-shifted sequences are MLS stimulus signals resulting from a modulo M shift of samples of the base MLS of FIG. 3A, wherein M=32K. In one embodiment, the loudspeaker-room equalization system 200 simultaneously excites the 11 distinct loudspeakers utilizing a continuous and circular stimuli that includes the 11 circularly-shifted sequences (generated via the stimuli determination unit 205).

Figure 4A:
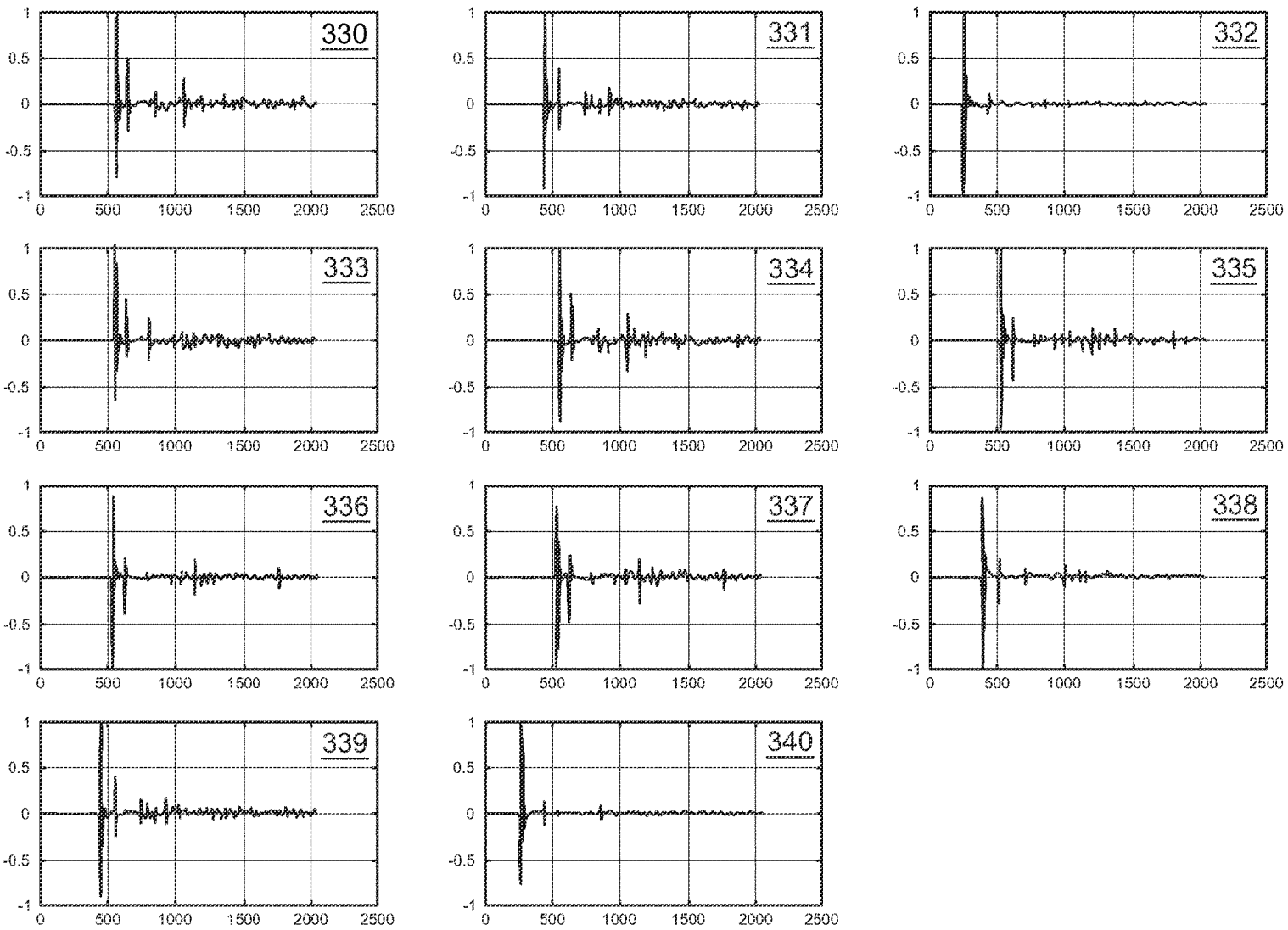
FIG. 4A illustrates zoomed-in plots of estimated impulse responses, in one or more embodiments.
Figure 4B:
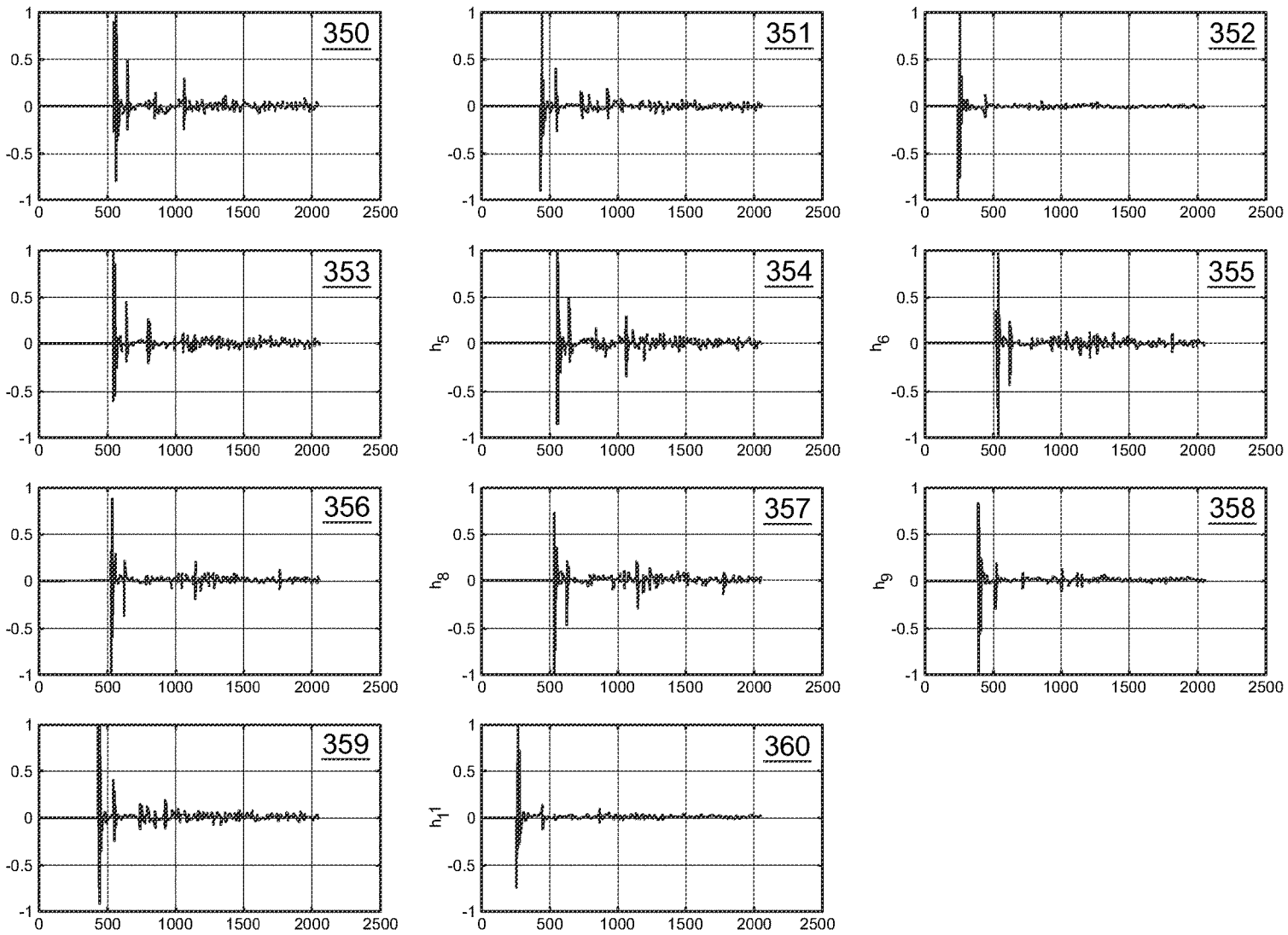
FIG. 4B illustrates zoomed-in plots of true impulse responses.
Figure 4C:
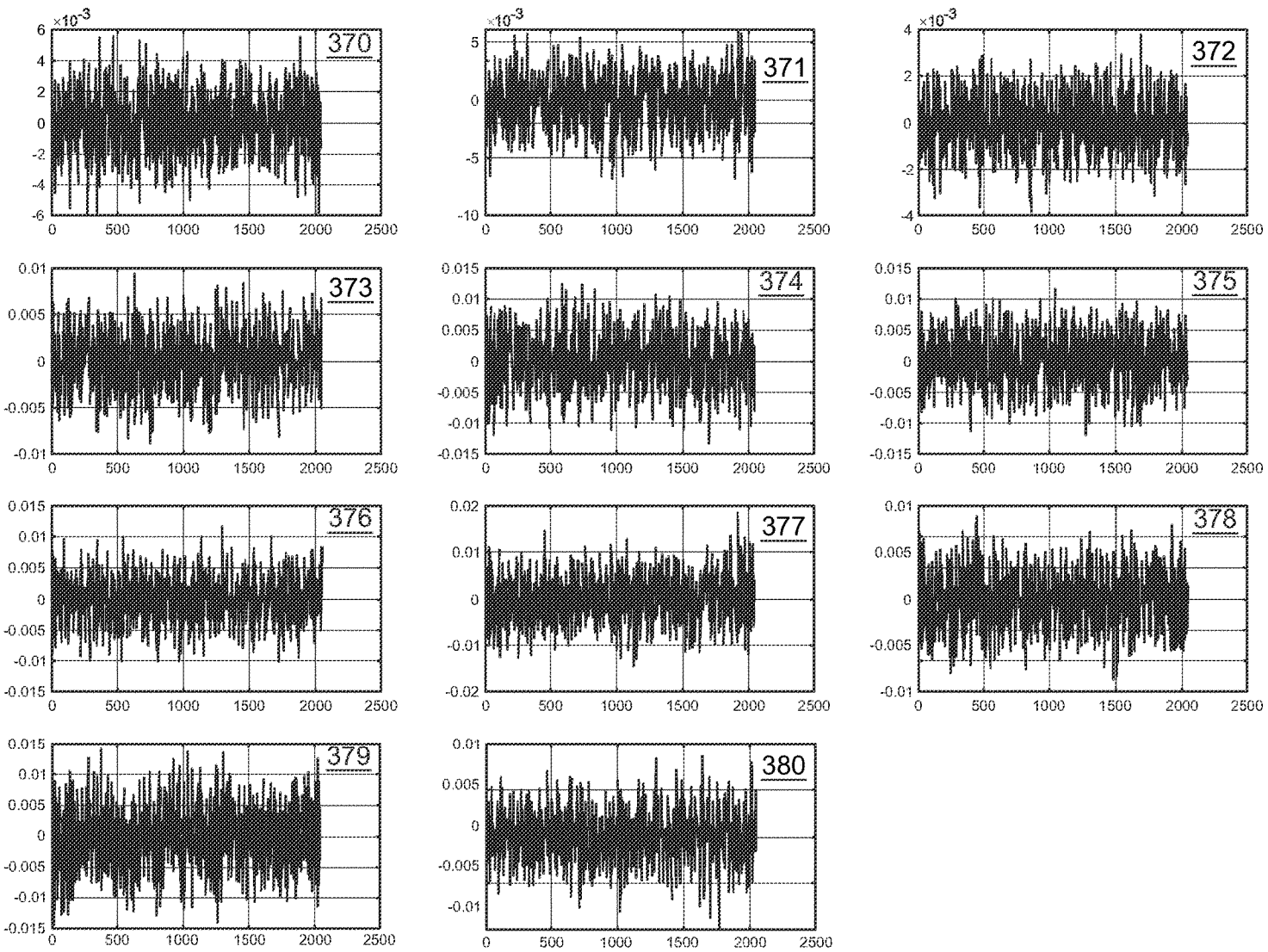
FIG. 4C illustrates zoomed-in plots of reconstruction errors between the true impulse responses of FIG. 4B and the estimated impulse responses of FIG. 4A, in one or more embodiments.

For FIGS. 4A-4C, assume an 11-loudspeaker setup (e.g., a 7.1.4 loudspeaker setup) comprising 11 distinct loudspeakers providing 11 loudspeaker channels. FIG. 4A illustrates zoomed-in plots 330-340 of estimated impulse responses, in one or more embodiments. A horizontal axis of each plot 330-340 represents time in seconds (s). A vertical axis of each plot 330-340 represents amplitude. In one embodiment, the loudspeaker-room equalization system 200, via the simultaneous deconvolution engine 230, extracts 11 estimated impulse responses after simultaneously exciting the 11 distinct loudspeakers with a continuous and circular stimuli that includes 11 stimulus signals that satisfy a Kronecker-delta cross-correlation after a circular shift of M samples. For example, the 11 stimulus signals may be the 11 circularly-shifted sequences of FIG. 3B (resulting from modulo M shift of samples of the base MLS of FIG. 3A, wherein M=16,384).

Plot 330 is an estimated impulse response $\hat{h}_1(n)$ of a first loudspeaker channel, plot 331 is an estimated impulse response $\hat{h}_2(n)$ of a second loudspeaker channel, plot 332 is an estimated impulse response $\hat{h}_3(n)$ of a third loudspeaker channel, plot 333 is an estimated impulse response $\hat{h}_4(n)$ of a fourth loudspeaker channel, plot 334 is an estimated impulse response $\hat{h}_5(n)$ of a fifth loudspeaker channel, plot 335 is an estimated impulse response $\hat{h}_6(n)$ of a sixth loudspeaker channel, plot 336 is an estimated impulse response $\hat{h}_7(n)$ of a seventh loudspeaker channel, plot 337 is an estimated impulse response $\hat{h}_8(n)$ of an eighth loudspeaker channel, plot 338 is an estimated impulse response $\hat{h}_9(n)$ of a ninth loudspeaker channel, plot 339 is an estimated impulse response $\hat{h}_{10}(n)$ of a tenth loudspeaker channel, and plot 340 is an estimated impulse response $\hat{h}_{11}(n)$ of an eleventh loudspeaker channel.

FIG. 4B illustrates zoomed-in plots 350-360 of true impulse responses. A horizontal axis of each plot 350-360 represents time in seconds (s). A vertical axis of each plot 350-360 represents amplitude. Plot 350 is a true impulse response $h_1(n)$ of the first loudspeaker channel, plot 351 is a true impulse response $h_2(n)$ of the second loudspeaker channel, plot 352 is a true impulse response $h_3(n)$ of the third loudspeaker channel, plot 353 is a true impulse response $h_4(n)$ of the fourth loudspeaker channel, plot 354 is a true impulse response $h_5(n)$ of the fifth loudspeaker channel, plot 355 is a true impulse response $h_6(n)$ of the sixth loudspeaker channel, plot 356 is a true impulse response $h_7(n)$ of the seventh loudspeaker channel, plot 357 is a true impulse response $h_8(n)$ of the eighth loudspeaker channel, plot 358 is a true impulse response $h_9(n)$ of the ninth loudspeaker channel, plot 359 is a true impulse response $h_{10}(n)$ of the tenth loudspeaker channel, and plot 360 is a true impulse response $h_{11}(n)$ of the eleventh loudspeaker channel.

FIG. 4C illustrates zoomed-in plots 370-380 of reconstruction errors between the true impulse responses of FIG.

4B and the estimated impulse responses of FIG. 4A, in one or more embodiments. A horizontal axis of each plot 370-380 represents time in seconds (s). A vertical axis of each plot 370-380 represents difference. Plot 370 is a first reconstruction error $e_1(n)$ (i.e., $h_1(n)-\hat{h}_1(n)$) for the first loudspeaker channel, plot 371 is a second reconstruction error $e_2(n)$ (i.e., $h_2(n)-\hat{h}_2(n)$) for the second loudspeaker channel, plot 372 is a third reconstruction error $e_3(n)$ (i.e., $h_3(n)-\hat{h}_3(n)$) for the third loudspeaker channel, plot 373 is a fourth reconstruction error $e_4(n)$ (i.e., $h_4(n)-\hat{h}_4(n)$) for the fourth loudspeaker channel, plot 374 is a fifth reconstruction error $e_5(n)$ (i.e., $h_5(n)-\hat{h}_5(n)$) for the fifth loudspeaker channel, plot 375 is a sixth reconstruction error $e_6(n)$ (i.e., $h_6(n)-\hat{h}_6(n)$) for the sixth loudspeaker channel, plot 376 is a seventh reconstruction error $e_7(n)$ (i.e., $h_7(n)-\hat{h}_7(n)$) for the seventh loudspeaker channel, plot 377 is an eighth reconstruction error $e_8(n)$ (i.e., $h_8(n)-\hat{h}_8(n)$) for the eighth loudspeaker channel, plot 378 is a ninth reconstruction error $e_9(n)$ (i.e., $h_9(n)-\hat{h}_9(n)$) for the ninth loudspeaker channel, plot 379 is a tenth reconstruction error $e_{10}(n)$ (i.e., $h_{10}(n)-\hat{h}_{10}(n)$) for the tenth loudspeaker channel, and plot 380 is an eleventh reconstruction error $e_{11}(n)$ (i.e., $h_{11}(n)-\hat{h}_{11}(n)$) for the eleventh loudspeaker channel. The reconstruction errors $e_1(n)$, $e_3(n)$, . . . , $e_{11}(n)$ are substantially low.

As an MLS is a statistically white sequence with flat power spectral density in the frequency domain, an MLS stimulus signal may be challenging to listen to during loudspeaker-room equalization. Additionally, to measure/record measurements of good quality, a reasonably high signal-to-noise ratio (SNR) in a region of interest (e.g., low-frequencies) is desirable. In one embodiment, to obtain measurements of good quality, the loudspeaker-room equalization system 200 applies a pre-emphasis filter to each of the N loudspeaker channels (i.e., a pre-emphasis filter is applied to each stimulus signal delivered to each of the N loudspeakers 121 for reproduction) before any measurements/recordings are measured/recorded via the P microphones 122. For example, in one embodiment, the loudspeaker-room equalization system 200 applies a single pre-emphasis filter f(n) to all the N loudspeaker channels (i.e., the same pre-emphasis filter is applied).

As another example, in one embodiment, the loudspeaker-room equalization system 200 applies multiple, unique pre-emphasis filters to the N loudspeaker channels (i.e., different pre-emphasis filters are applied to different stimulus signals delivered to the N loudspeakers 121 for reproduction). Specifically, for each loudspeaker channel i of the N loudspeaker channels, the loudspeaker-room equalization system 200 applies a unique pre-emphasis filter $f_i(n)$ to the loudspeaker channel i.

In one embodiment, the loudspeaker-room equalization system 200 simultaneously excites all the N loudspeakers 121 within the room 150 with arbitrary stimuli (including shaped versions of the stimuli). For example, in one embodiment, the unique pre-emphasis filters are randomly generated. As another example, in one embodiment, the unique pre-emphasis filters are pre-designed such that resulting stimulus signals simultaneously excite all the N loudspeakers 121 within the room 150 to reproduce sound that is pleasant-sounding or musical-like in nature.

In one embodiment, any pre-emphasis filter applied by the loudspeaker-room equalization system 200 (e.g., the same pre-emphasis filter or different pre-emphasis filters) is a minimum-phase filter (i.e., zeros and/or poles inside unit circle) that is invertible during the simultaneous deconvolution (via the simultaneous deconvolution engine 230). In one embodiment, if a pre-emphasis filter is applied to each of the N loudspeaker channels, a measurement/recording y(n) is expressed in accordance with equation (6) provided below:

$$y(n)=\Sigma_{i=1}^{N}[x_i(n)\circledast f_{i,min\text{-}phase}(n)]\circledast h_i(n) \quad (6),$$

wherein $f_{i,min\text{-}phase}(n)$ is a minimum-phase filter.

In one embodiment, a unique pre-emphasis filter $f_i(n)$ applied to loudspeaker channel i is expressed in accordance with equation (7) provided below:

$$f_i(n)=f_{i,min\text{-}phase}(n)\circledast f_{i,all\text{-}pass}(n) \quad (7),$$

wherein $f_{i,all\text{-}phase}(n)$ is an all-pass filter.

In one embodiment, if a pre-emphasis filter is applied to each of the N loudspeaker channels, the simultaneous deconvolution engine 230 determines an estimated impulse response $\hat{h}_j^f(n)$ of loudspeaker channel j in accordance with equations (8)-(9) provided below:

$$w_i(n)=\mathcal{F}^{-1}\left(\frac{1}{F_{i,min-phase}(e^{j\omega})}\right), \quad (8)$$

wherein $\mathcal{F}^{-1}$ is an inverse Fourier Transform, and $$\hat{h}_j^f(n)=w_j(n)\circledast \rho_{(x_j(n),y(n))} \quad (9).$$

Figure 5A:
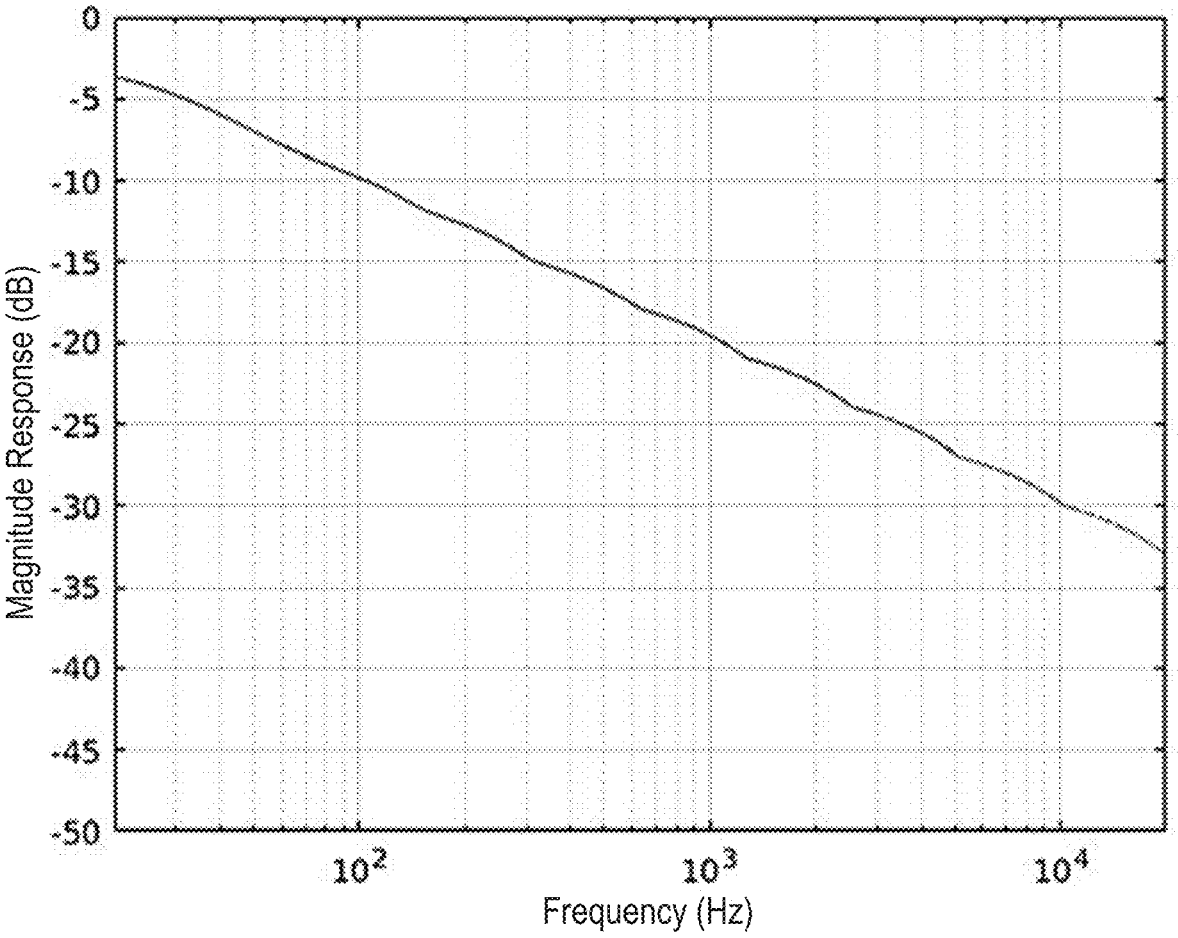
FIG. 5A is a graph illustrating a single pre-emphasis filter, in one or more embodiments.
Figure 5B:
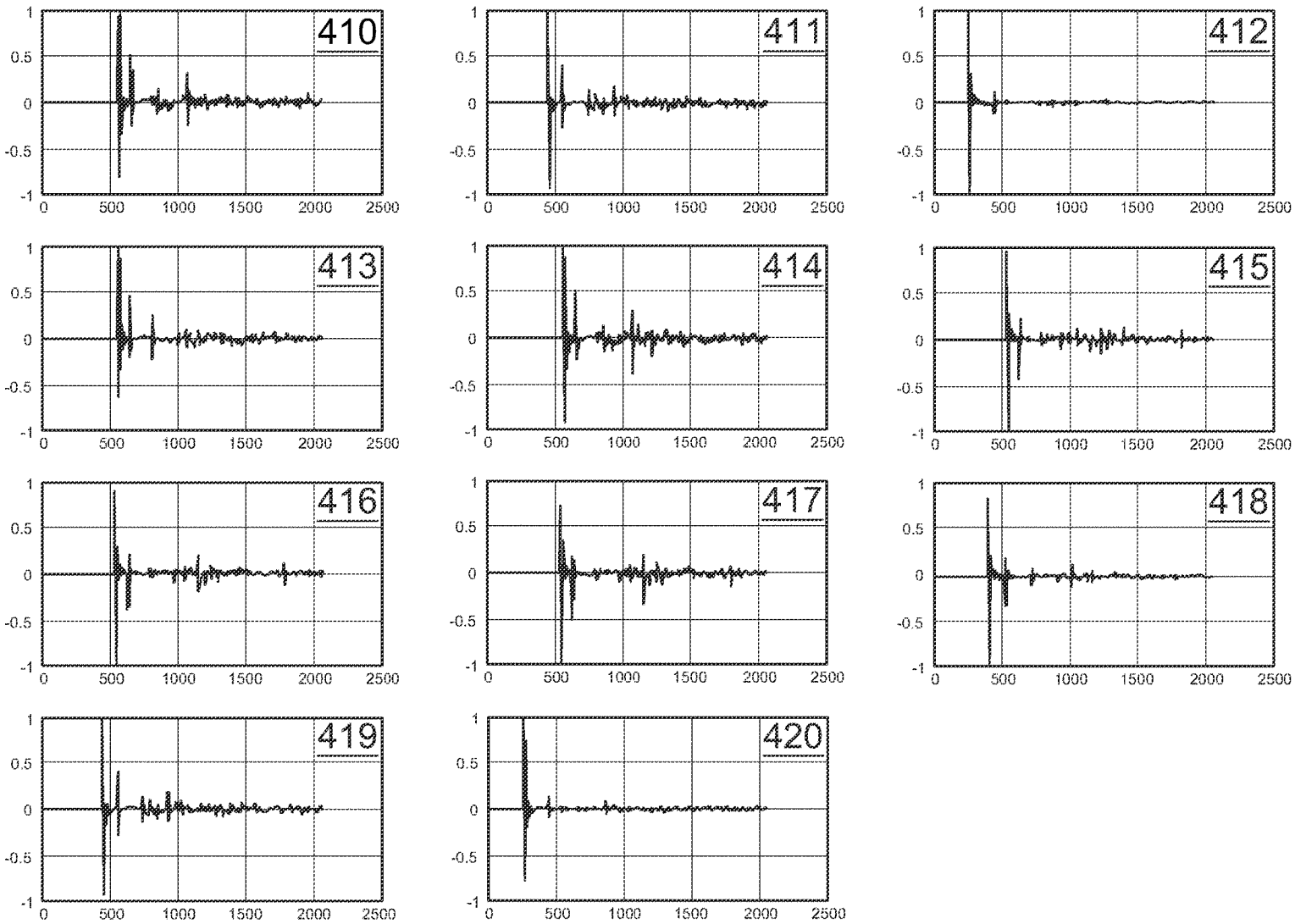
FIG. 5B illustrates zoomed-in plots of estimated impulse responses, in one or more embodiments.

For FIGS. 5A-5B, assume an 11-loudspeaker setup (e.g., a 7.1.4 loudspeaker setup) comprising 11 distinct loudspeakers providing 11 loudspeaker channels. FIG. 5A is a graph 400 illustrating a single pre-emphasis filter f(n), in one or more embodiments. A horizontal axis of the graph 400 represents frequency in Hertz (Hz). A vertical axis of the graph 400 represents magnitude response in decibels (dB). In one embodiment, the loudspeaker-room equalization system 200 applies the same pre-emphasis filter f(n) to all the 11 loudspeaker channels. For example, the pre-emphasis filter f(n) may be a pink-noise shaped filter that mimics pink-noise spectral roll-off.

FIG. 5B illustrates zoomed-in plots 410-420 of estimated impulse responses, in one or more embodiments. A horizontal axis of each plot 410-420 represents time in seconds (s). A vertical axis of each plot 410-420 represents amplitude. In one embodiment, after the single pre-emphasis filter f(n) of FIG. 5A is applied to all the 11 loudspeaker channels, the loudspeaker-room equalization system 200, via the simultaneous deconvolution engine 230, extracts 11 estimated impulse responses after simultaneously exciting the 11 distinct loudspeakers with a continuous and circular stimuli that includes 11 stimulus signals (e.g., the 11 circularly-shifted sequences of FIG. 3B).

Plot 410 is an estimated impulse response $\hat{h}_1^f(n)$ of a first loudspeaker channel, plot 411 is an estimated impulse response $\hat{h}_2^f(n)$ of a second loudspeaker channel, plot 412 is an estimated impulse response $\hat{h}_3^f(n)$ of a third loudspeaker channel, plot 413 is an estimated impulse response $\hat{h}_4^f(n)$ of a fourth loudspeaker channel, plot 414 is an estimated impulse response $\hat{h}_5^f(n)$ of a fifth loudspeaker channel, plot 415 is an estimated impulse response $\hat{h}_6^f(n)$ of a sixth loudspeaker channel, plot 416 is an estimated impulse response $\hat{h}_7^f(n)$ of a seventh loudspeaker channel, plot 417 is an estimated impulse response $\hat{h}_8^f(n)$ of an eighth loudspeaker channel, plot 418 is an estimated impulse response $\hat{h}_9^f(n)$ of a ninth loudspeaker channel, plot 419 is an estimated impulse response $\hat{h}_{10}^f(n)$ of a tenth loudspeaker channel, and plot 420 is an estimated impulse response $\hat{h}_{11}^f(n)$ of an eleventh loudspeaker channel.

Figure 6A:
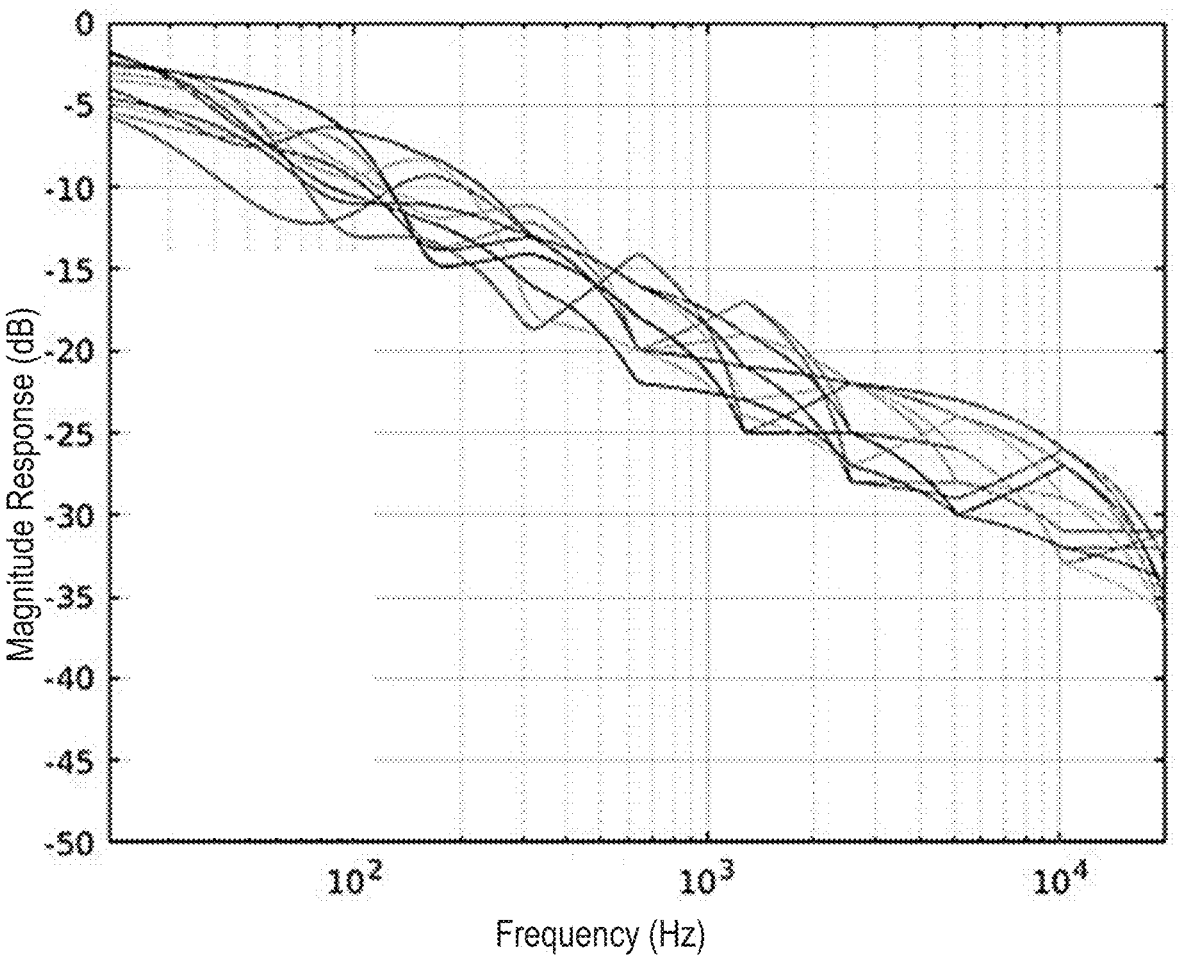
FIG. 6A is a graph illustrating multiple, unique pre-emphasis filters, in one or more embodiments.
Figure 6B:
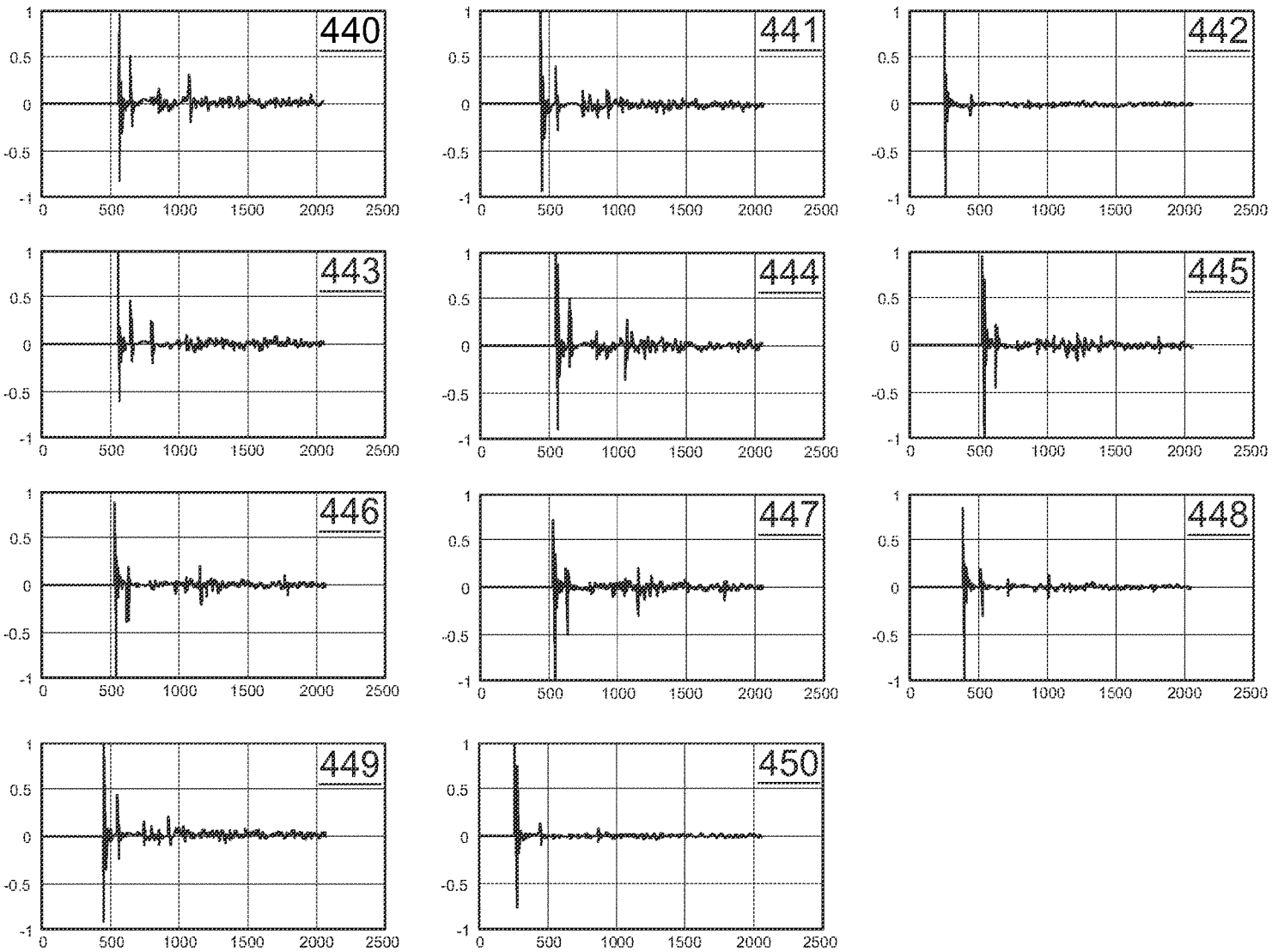
FIG. 6B illustrates zoomed-in plots of estimated impulse responses, in one or more embodiments.
Figure 6C:
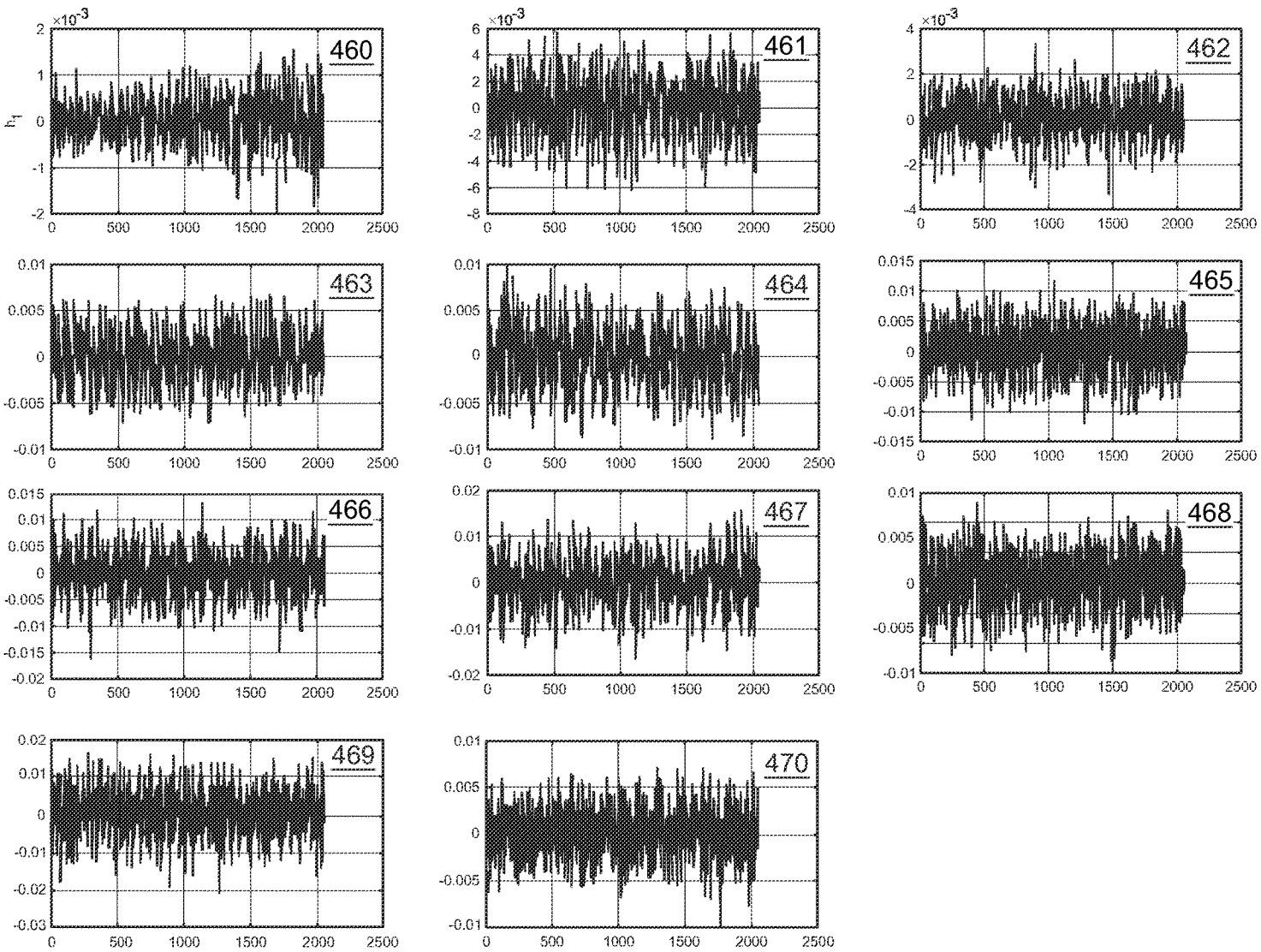
FIG. 6C illustrates zoomed-in plots of reconstruction errors between true impulse responses and the estimated impulse responses of FIG. 6B, in one or more embodiments.

For FIGS. 6A-6C, assume an 11-loudspeaker setup (e.g., a 7.1.4 loudspeaker setup) comprising 11 distinct loudspeakers providing 11 loudspeaker channels. FIG. 6A is a graph 430 illustrating multiple, unique pre-emphasis filters, in one or more embodiments. A horizontal axis of the graph 430 represents frequency in Hertz (Hz). A vertical axis of the graph 430 represents magnitude response in decibels (dB). In one embodiment, for each loudspeaker channel i of the 11 loudspeaker channels, the loudspeaker-room equalization system 200 applies a unique pre-emphasis filter $f_i(n)$ to the loudspeaker channel i. Specifically, the loudspeaker-room equalization system 200 applies 11 unique pre-emphasis filters $f_1(n)$, $f_2(n)$, . . . , and $f_{11}(n)$ to a first loudspeaker channel, a second loudspeaker channel, . . . , and an eleventh loudspeaker channel, respectively.

In one embodiment, the 11 unique pre-emphasis filters are randomly generated. In one embodiment, the 11 unique pre-emphasis filters are pre-designed such that resulting stimulus signals simultaneously excite the 11 distinct loudspeakers to reproduce sound that is pleasant-sounding or musical-like in nature. In one embodiment, each of the 11 unique pre-emphasis filters mimics a unique spectral roll-off.

FIG. 6B illustrates zoomed-in plots 440-450 of estimated impulse responses, in one or more embodiments. A horizontal axis of each plot 440-450 represents time in seconds (s). A vertical axis of each plot 440-450 represents amplitude. In one embodiment, after the multiple, unique pre-emphasis filters of FIG. 6A are applied to the 11 loudspeaker channels, the loudspeaker-room equalization system 200, via the simultaneous deconvolution engine 230, extracts 11 estimated impulse responses after simultaneously exciting the 11 distinct loudspeakers with a continuous and circular stimuli that includes 11 stimulus signals (e.g., the 11 circularly-shifted sequences of FIG. 3B).

Plot 440 is an estimated impulse response $\hat{h}_1^f(n)$ of the first loudspeaker channel after the first unique pre-emphasis filter $f_1(n)$ is applied, plot 441 is an estimated impulse response $\hat{h}_2^f(n)$ of the second loudspeaker channel after the second unique pre-emphasis filter $f_2(n)$ is applied, plot 442 is an estimated impulse response $\hat{h}_3^f(n)$ of the third loudspeaker channel after the third unique pre-emphasis filter $f_3(n)$ is applied, plot 443 is an estimated impulse response $\hat{h}_4^f(n)$ of the fourth loudspeaker channel after the fourth unique pre-emphasis filter $f_4(n)$ is applied, plot 444 is an estimated impulse response $\hat{h}_5^f(n)$ of the fifth loudspeaker channel after the fifth unique pre-emphasis filter $f_5(n)$ is applied, plot 445 is an estimated impulse response $\hat{h}_6^f(n)$ of the sixth loudspeaker channel after the sixth unique pre-emphasis filter $f_6(n)$ is applied, plot 446 is an estimated impulse response $\hat{h}_7^f(n)$ of the seventh loudspeaker channel after the seventh unique pre-emphasis filter $f_7(n)$ is applied, plot 447 is an estimated impulse response $\hat{h}_8^f(n)$ of the eighth loudspeaker channel after the eighth unique pre-emphasis filter $f_8(n)$ is applied, plot 448 is an estimated impulse response $\hat{h}_9^f(n)$ of the ninth loudspeaker channel after the ninth unique pre-emphasis filter $f_9(n)$ is applied, plot 449 is an estimated impulse response $\hat{h}_{10}^f(n)$ of the tenth loudspeaker channel after the tenth unique pre-emphasis filter $f_{10}(n)$ is applied, and plot 450 is an estimated impulse response $\hat{h}_{11}^f(n)$ of the eleventh loudspeaker channel after the eleventh unique pre-emphasis filter $f_{11}(n)$ is applied.

FIG. 6C illustrates zoomed-in plots 460-470 of reconstruction errors between true impulse responses and the estimated impulse responses of FIG. 6B, in one or more embodiments. A horizontal axis of each plot 460-470 represents time in seconds (s). A vertical axis of each plot 460-470 represents difference. Specifically, plot 460 is a first reconstruction error $e_1(n)$ (i.e., $h_1(n)-\hat{h}_1^f(n)$) for the first loudspeaker channel, plot 461 is a second reconstruction error $e_2(n)$ (i.e., $h_2(n)-\hat{h}_2^f(n)$) for the second loudspeaker channel, plot 462 is a third reconstruction error $e_3(n)$ (i.e., $h_3(n)-\hat{h}_3^f(n)$) for the third loudspeaker channel, plot 463 is a fourth reconstruction error $e_4(n)$ (i.e., $h_4(n)-\hat{h}_4^f(n)$) for the fourth loudspeaker channel, plot 464 is a fifth reconstruction error $e_5(n)$ (i.e., $h_5(n)-\hat{h}_5^f(n)$) for the fifth loudspeaker channel, plot 465 is a sixth reconstruction error $e_6(n)$ (i.e., $h_6(n)-\hat{h}_6^f(n)$) for the sixth loudspeaker channel, plot 466 is a seventh reconstruction error $e_7(n)$ (i.e., $h_7(n)-\hat{h}_7^f(n)$) for the seventh loudspeaker channel, plot 467 is an eighth reconstruction error $e_8(n)$ (i.e., $h_8(n)-\hat{h}_8^f(n)$) for the eighth loudspeaker channel, plot 468 is a ninth reconstruction error $e_9(n)$ (i.e., $h_9(n)-\hat{h}_9^f(n)$) for the ninth loudspeaker channel, plot 469 is a tenth reconstruction error $e_{10}(n)$ (i.e., $h_{10}(n)-\hat{h}_{10}^f(n)$) for the tenth loudspeaker channel, and plot 470 is an eleventh reconstruction error $e_{11}(n)$ (i.e., $h_{11}(n)-\hat{h}_{11}^f(n)$) for the eleventh loudspeaker channel. The reconstruction errors $e_1(n)$, $e_3(n)$, $e_{11}(n)$ are substantially low.

In another embodiment, the loudspeaker-room equalization system 200 simultaneously excites all the N loudspeakers 121 within the room 150 with a logarithmic sweep (i.e., log-sweep) stimuli or a combination of log-sweep stimuli (generated via the stimuli determination unit 205). A log-sweep stimulus signal is expressed in accordance with equation (10) provided below:

$$x(t) = \sin\left[\frac{\omega_1 \cdot T}{\ln\left(\frac{\omega_2}{\omega_1}\right)} \cdot \left(e^{\frac{t}{T}\cdot\ln\left(\frac{\omega_2}{\omega_1}\right)} - 1\right)\right], \tag{10}$$

wherein $\omega_1$ is a first/start frequency, $\omega_2$ is a last/final frequency, T is an end time (or sweep duration) in seconds corresponding to the last/final frequency $\omega_2$.

In one embodiment, to simultaneously deconvolve the N loudspeaker-room impulse responses, two log-sweep stimulus signals $x_i$ and $x_j$ to be reproduced by two distinct loudspeakers i and j within the room 150 are generated (via the stimuli determination unit 205) in accordance with equations (11)-(12) provided below:

$$x_i(n)=\sin(\omega_1,\omega_2,M) \quad \text{(11), and}$$

$$x_j(n)=x_i(n)\bmod(jM) \quad (12),$$

wherein $j \in [1, N-1]$.

In one embodiment, if all the N loudspeakers 121 are simultaneously excited with log-sweep stimulus signals, a measurement/recording y(n) is expressed in accordance with equation (13) provided below:

$$y(n)=\Sigma_{i=1}^{N} x_k(n) \circledast h_k(n) \quad (13),$$

wherein $k \in [1, N]$.

In one embodiment, if all the N loudspeakers 121 are simultaneously excited with log-sweep stimulus signals, the simultaneous deconvolution engine 230 determines an estimated impulse response $\hat{h}_k(n)$ of loudspeaker channel k in accordance with equations (14)-(15) provided below:

$$\psi_k(n) = \mathcal{F}^{-1}\left\{\frac{1}{\mathcal{F}\{r(x_k(n),\, x_k(n))\}}\right\}, \tag{14}$$

wherein $\mathcal{F}^{-1}$ is an inverse Fourier Transform, and $$\hat{h}_k(n)=\psi_k(n)\circledast r(y(n),x_k(n)) \quad (15).$$

Figure 7A:
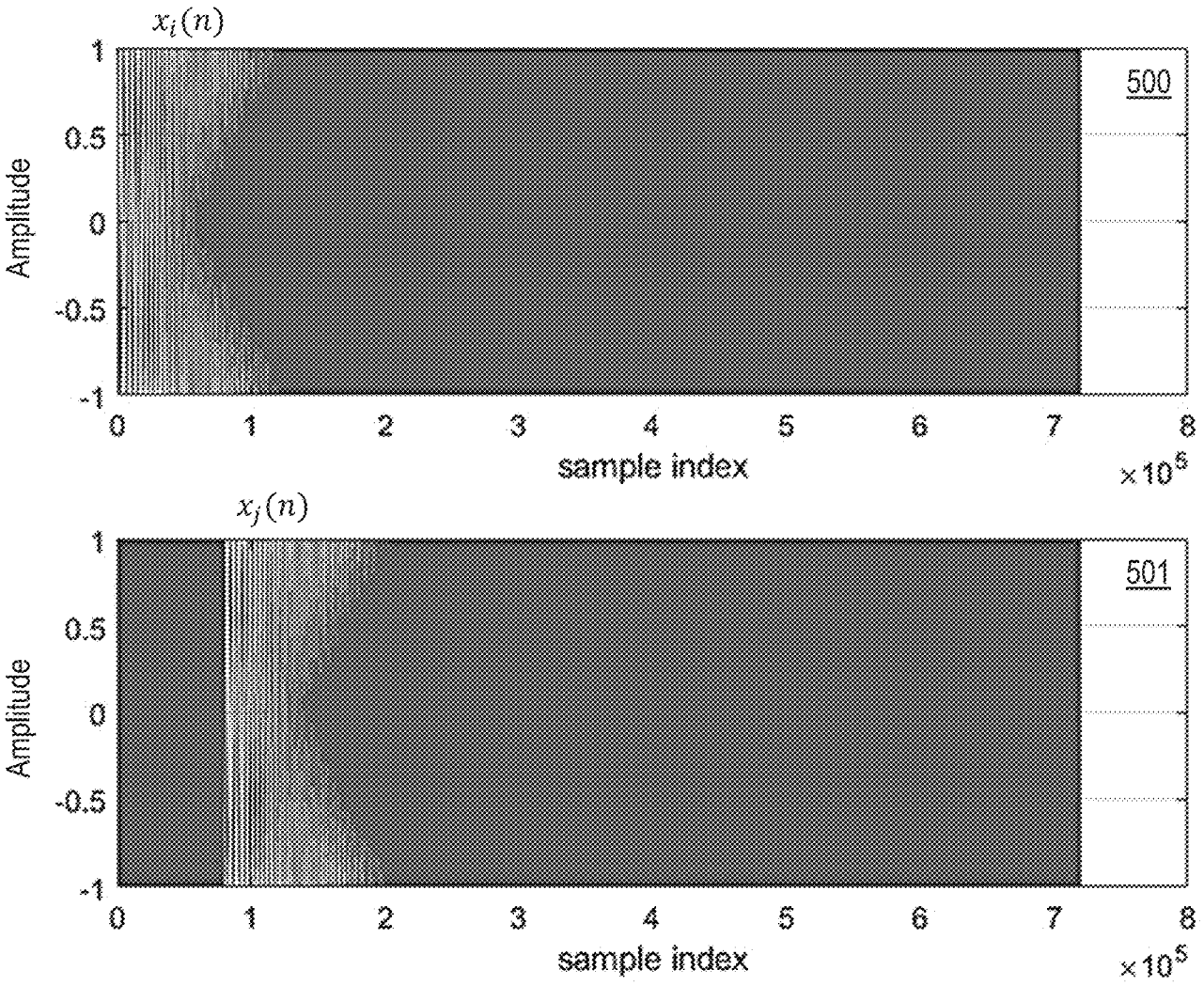
FIG. 7A illustrates zoomed-in plots of logarithmic sweep stimulus signals, in one or more embodiments.
Figure 7B:
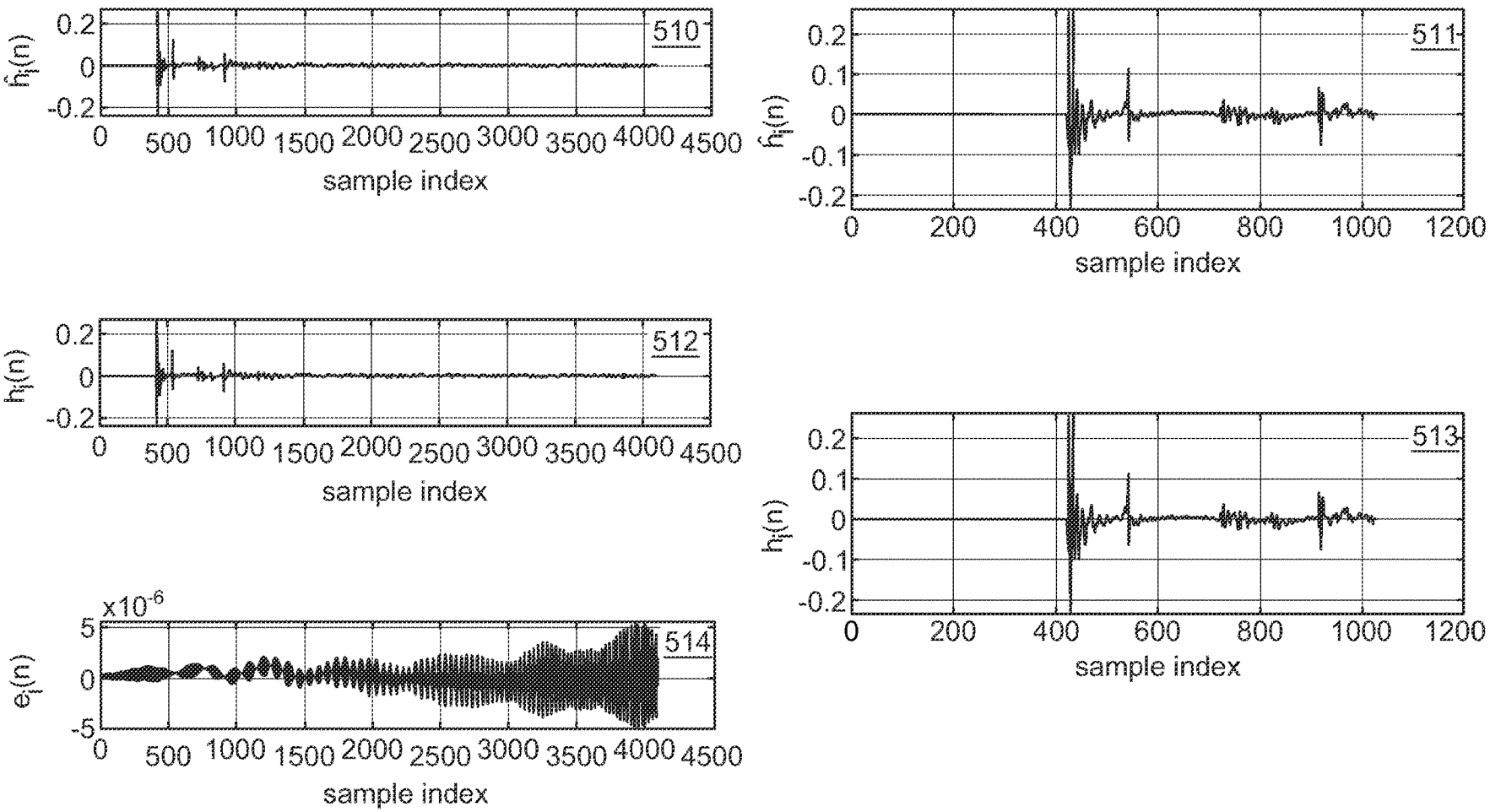
FIG. 7B illustrates plots for a loudspeaker, in one or more embodiments.
Figure 7C:
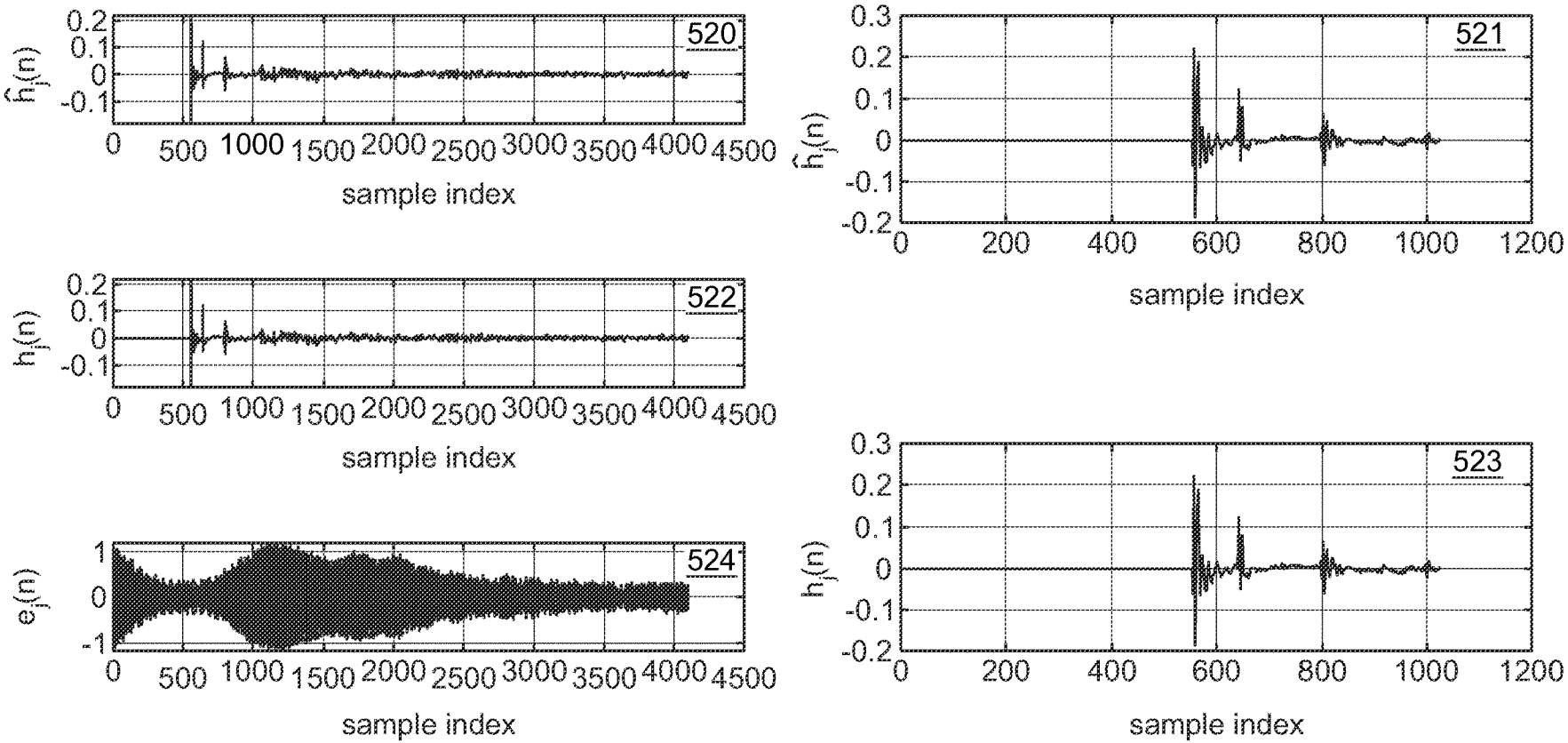
FIG. 7C illustrates plots for another loudspeaker, in one or more embodiments.

For FIGS. 7A-7C, assume an 11-loudspeaker setup (e.g., a 7.1.4 loudspeaker setup) comprising 11 distinct loudspeakers providing 11 loudspeaker channels. FIG. 7A illustrates zoomed-in plots 500-501 of log-sweep stimulus signals, in one or more embodiments. A horizontal axis of each plot 500-501 represents sample index. A vertical axis of each plot 500-501 represents amplitude. In one embodiment, the loudspeaker-room equalization system 200 utilizes 11 log-sweep stimulus signals (generated via the stimuli determination unit 205) to simultaneously excite the 11 distinct loudspeakers.

Plot 500 is a log-sweep stimulus signal $x_i(n)$ for exciting loudspeaker i of the 11-loudspeaker setup, and plot 501 is another log-sweep stimulus signal $x_j(n)$ for exciting loudspeaker j of the 11-loudspeaker setup, wherein loudspeakers i and j are distinct loudspeakers 121 within the room 150. Each log-sweep stimulus signal $x_i(n)$, $x_1(n)$ is 10 Hz-24 kHz. In one embodiment, the other log-sweep stimulus signal $x_j(n)$ is circularly shifted relative to the log-sweep stimulus signal $x_i(n)$ by 8000 samples.

In one embodiment, the loudspeaker-room equalization system 200, via the simultaneous deconvolution engine 230, extracts 11 estimated impulse responses after simultaneously exciting the 11 distinct loudspeakers with the 11 log-sweep stimulus signals.

FIG. 7B illustrates plots 510-514 for loudspeaker i, in one or more embodiments. A horizontal axis of each plot 510-513 represents sample index. A vertical axis of each plot 510-513 represents amplitude. A horizontal axis of plot 514 represents time in seconds (s). A vertical axis of plot 514 represents difference. Plot 510 is an estimated impulse response $\hat{h}_i(n)$ of loudspeaker i that is extracted after exciting loudspeaker i with the log-sweep stimulus signal $x_i(n)$, plot 511 is a zoom-in of the plot 510, plot 512 is a true impulse response $h_i(n)$ of loudspeaker i, plot 513 is a zoom-in of the plot 512, and plot 514 is a reconstruction error $e_i(n)$ (i.e., $h_i(n)-\hat{h}_i(n)$) for loudspeaker i.

FIG. 7C illustrates plots 520-524 for loudspeaker j, in one or more embodiments. A horizontal axis of each plot 520-523 represents sample index. A vertical axis of each plot 520-523 represents amplitude. A horizontal axis of plot 524 represents time in seconds (s). A vertical axis of plot 524 represents difference. Plot 520 is an estimated impulse response $\hat{h}_j(n)$ of loudspeaker j that is extracted after exciting loudspeaker j with the log-sweep stimulus signal $x_j(n)$, plot 521 is a zoom-in of the plot 520, plot 522 is a true impulse response $h_j(n)$ of loudspeaker j, plot 523 is a zoom-in of the plot 522, and plot 524 is a reconstruction error $e_j(n)$ (i.e., $h_j(n)-\hat{h}_j(n)$) for loudspeaker j. The reconstruction errors $e_i(n)$ and $e_j(n)$ are substantially low.

In another embodiment, the loudspeaker-room equalization system 200 simultaneously excites all the N loudspeakers 121 within the room 150 with a multi-tone stimuli or a combination of multi-tone stimuli (generated via the stimuli determination unit 205). A multi-tone stimulus signal may be a multi-tone-white stimulus signal or a multi-tone-pink stimulus signal. A multi-tone-white stimulus signal is expressed in accordance with equation (16) provided below:

$$u(t)=\sum_{k=\frac{N}{2}+1}^{\frac{N}{2}-1} U_k e^{j\omega_k t}, \quad (16)$$

wherein $\angle U_k \in [0, 2\pi]$ (uniform).

In one embodiment, to simultaneously deconvolve the N loudspeaker-room impulse responses, two multi-tone-white stimulus signals $x_i$ and $x_j$ to be reproduced by two distinct loudspeakers i and j must satisfy a condition represented by equation (17) provided below:

$$E\{x_i(n)x_j(n)\}=\Sigma_m x_i[(n)]x_j[(m+n)\bmod M]=\delta(n-M) \quad (17),$$

wherein E denotes a statistical expectation.

In one embodiment, if all the N loudspeakers 121 are simultaneously excited with multi-tone stimulus signals, a measurement/recording y(n) is expressed in accordance with equation (18) provided below:

$$y(n)=\Sigma_{k=1}^{N} x_k(n)\circledast h_k(n) \quad (18),$$

wherein $k \in [1, N]$.

In one embodiment, if all the N loudspeakers 121 are simultaneously excited with multi-tone stimulus signals, the simultaneous deconvolution engine 230 determines an estimated impulse response $\hat{h}_k(n)$ of loudspeaker channel k in accordance with equation (19) provided below:

$$\hat{h}_k(n)=r(x_x(n),y(n)) \quad (19).$$

Figure 8A:
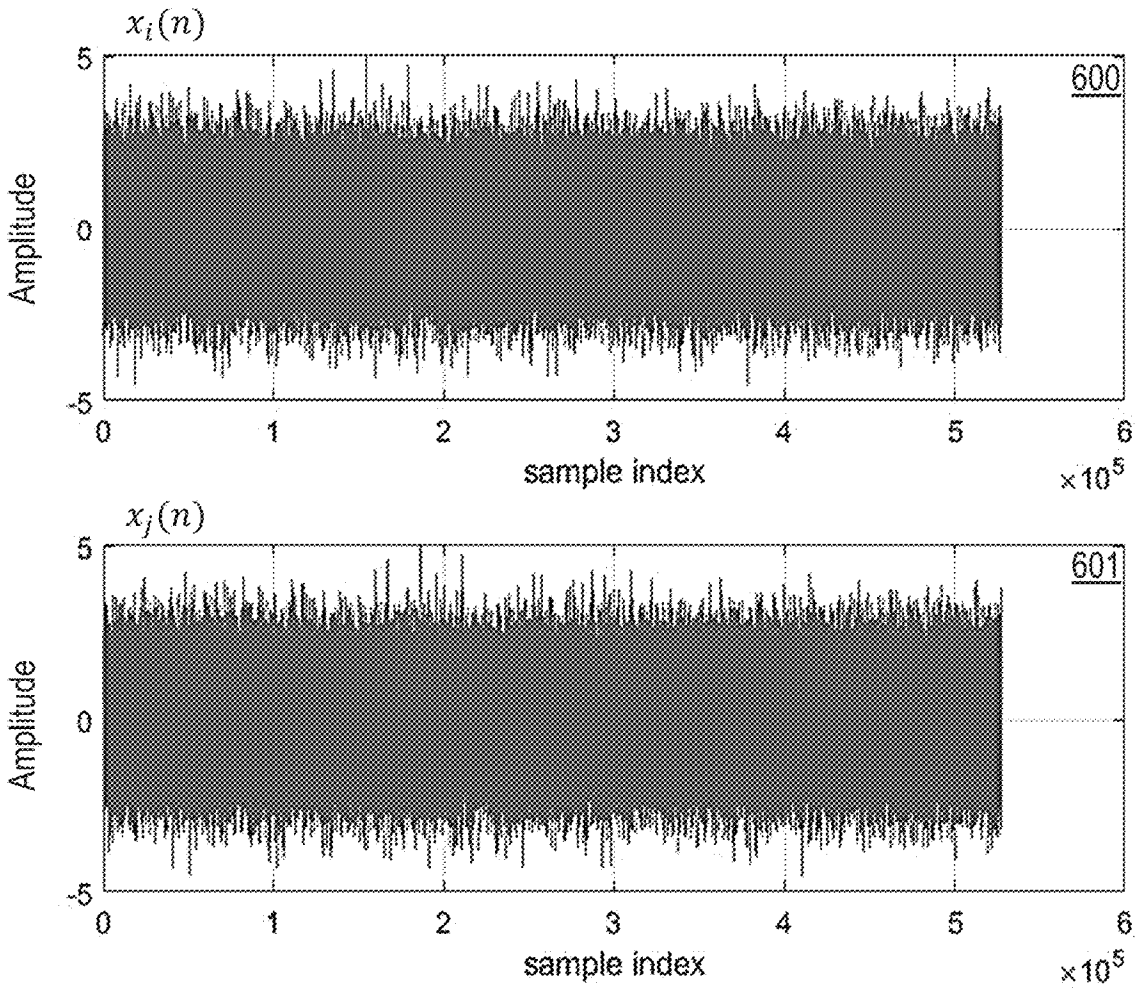
FIG. 8A illustrates zoomed-in plots of multi-tone-white stimulus signals, in one or more embodiments.
Figure 8B:
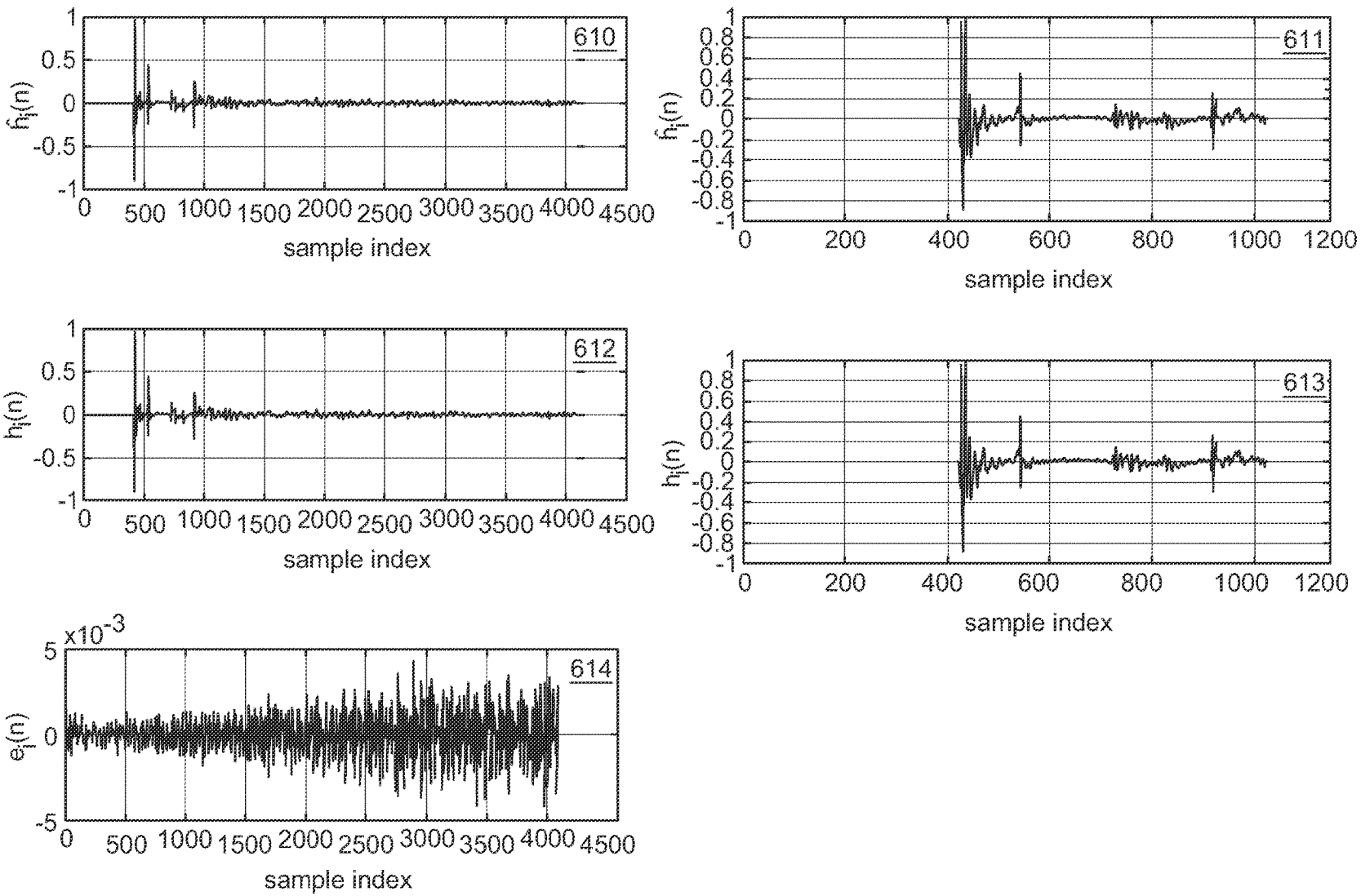
FIG. 8B illustrates plots for a loudspeaker, in one or more embodiments.

For FIGS. 8A-8B, assume an 11-loudspeaker setup (e.g., a 7.1.4 loudspeaker setup) comprising 11 distinct loudspeakers providing 11 loudspeaker channels. FIG. 8A illustrates zoomed-in plots 600-601 of multi-tone-white stimulus signals, in one or more embodiments. A horizontal axis of each plot 600-601 represents sample index. A vertical axis of each plot 600-601 represents amplitude. In one embodiment, the loudspeaker-room equalization system 200 utilizes 11 multi-tone-white stimulus signals (generated via the stimuli determination unit 205) to simultaneously excite the 11 distinct loudspeakers.

Plot 600 is a multi-tone-white stimulus $x_i(n)$ for exciting loudspeaker i of the 11-loudspeaker setup, and plot 601 is another log-sweep stimulus signal $x_j(n)$ for exciting loudspeaker j of the 11-loudspeaker setup, wherein loudspeakers i and j are distinct loudspeakers 121 within the room 150.

In one embodiment, the loudspeaker-room equalization system 200, via the simultaneous deconvolution engine 230, extracts 11 estimated impulse responses after simultaneously exciting the 11 distinct loudspeakers with the 11 multi-tone-white stimulus signals.

FIG. 8B illustrates plots 610-614 for loudspeaker i, in one or more embodiments. A horizontal axis of each plot 610-613 represents sample index. A vertical axis of each plot 610-613 represents amplitude. A horizontal axis of plot 614 represents time in seconds (s). A vertical axis of plot 614 represents difference. Plot 610 is an estimated impulse response $\hat{h}_i(n)$ of loudspeaker i that is extracted after exciting loudspeaker i with the multi-tone-white stimulus signal $x_i(n)$, plot 611 is a zoom-in of the plot 610, plot 612 is a true impulse response $h_i(n)$ of loudspeaker i, plot 613 is a zoom-in of the plot 612, and plot 614 is a reconstruction error e (n) (i.e., $h_i(n)-\hat{h}_i(n)$) for loudspeaker i. The reconstruction error e (n) is substantially low.

Figure 9A:
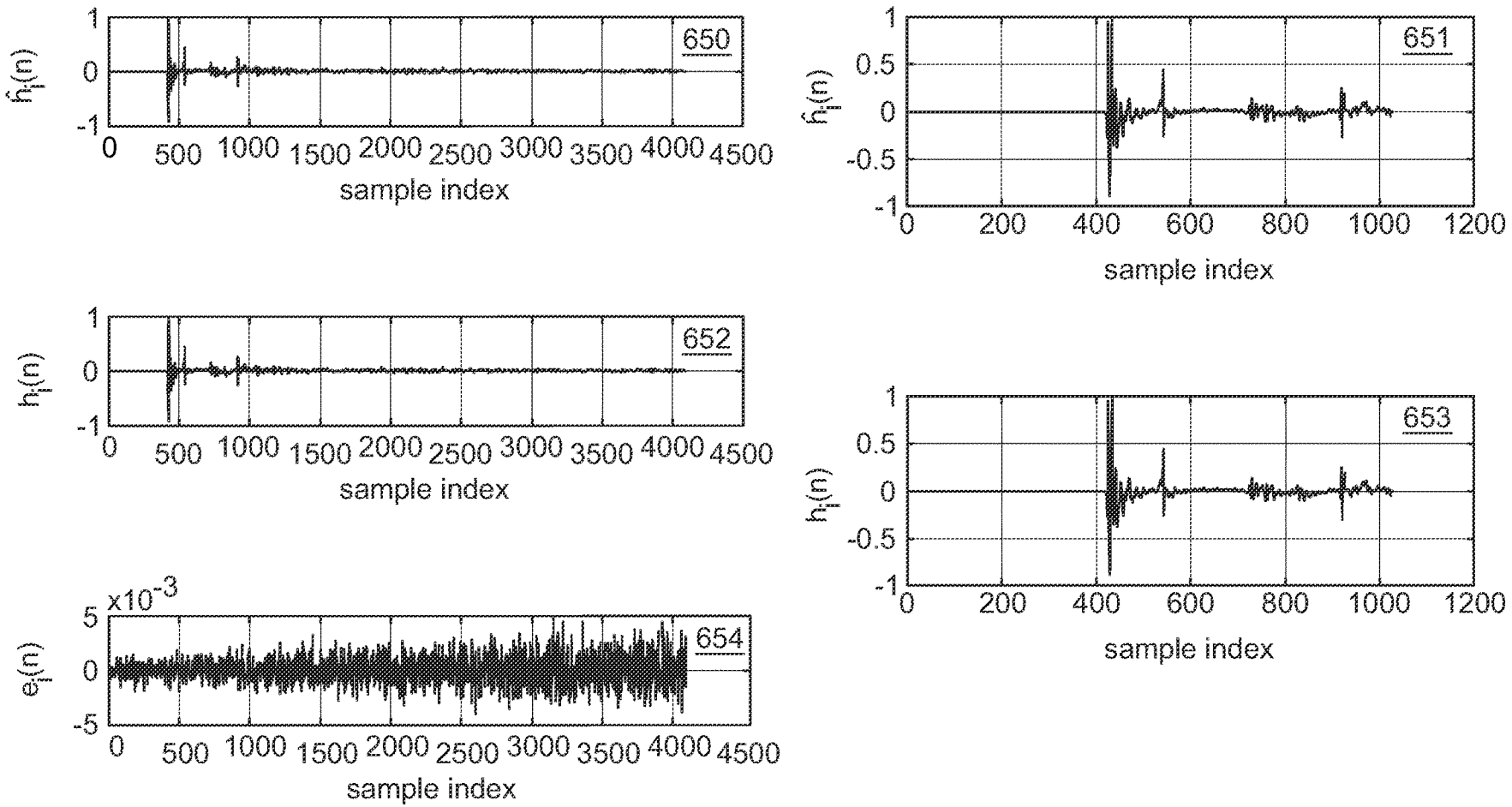
FIG. 9A illustrates plots for a loudspeaker, in one or more embodiments.
Figure 9B:
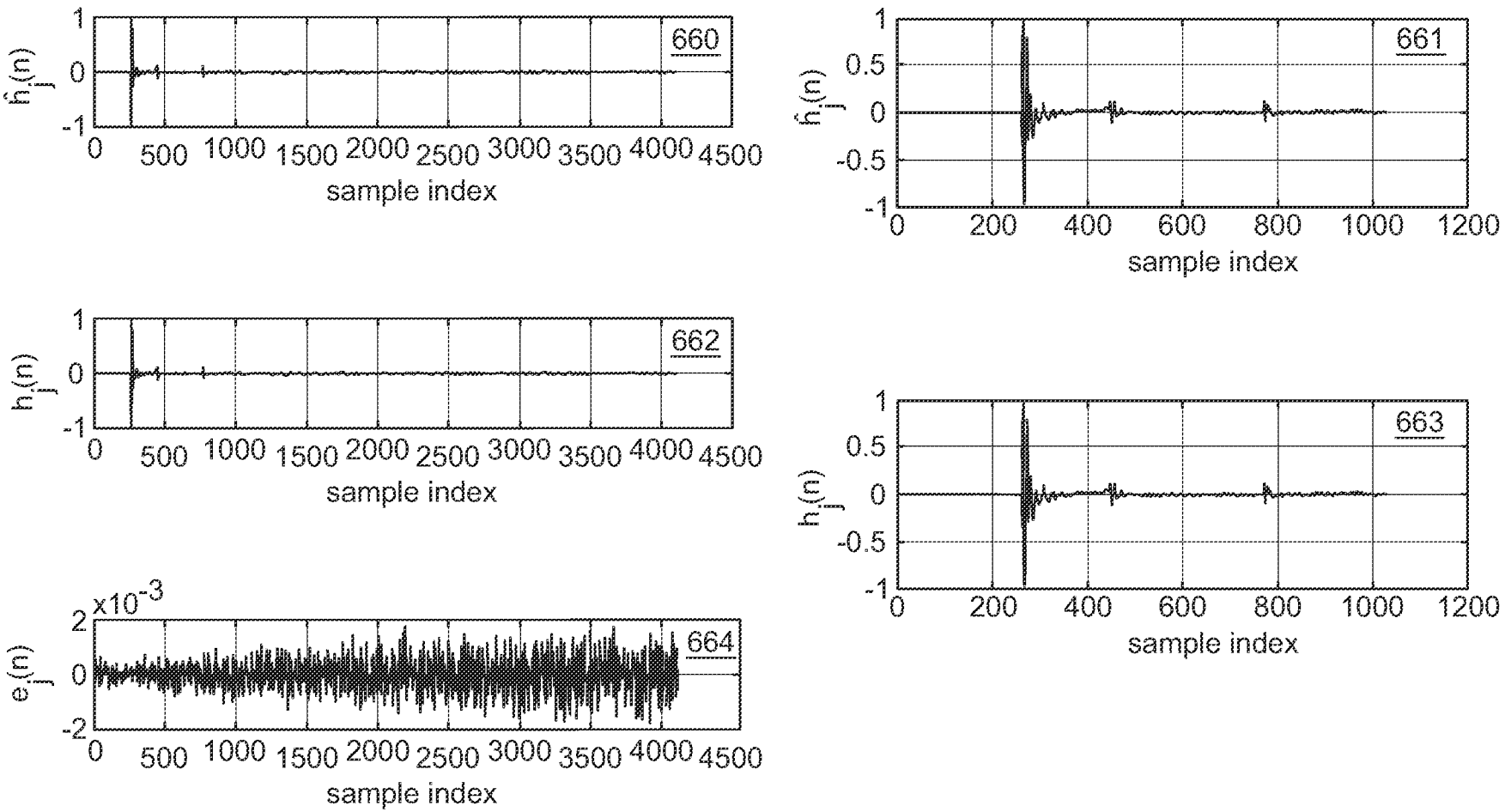
FIG. 9B illustrates plots for another loudspeaker, in one or more embodiments.

For FIGS. 9A-9B, assume an 11-loudspeaker setup (e.g., a 7.1.4 loudspeaker setup) comprising 11 distinct loudspeakers providing 11 loudspeaker channels. FIG. 9A illustrates plots 650-654 for loudspeaker i, in one or more embodiments. A horizontal axis of each plot 650-653 represents sample index. A vertical axis of each plot 650-653 represents amplitude. A horizontal axis of plot 654 represents time in seconds (s). A vertical axis of plot 654 represents difference. In one embodiment, the loudspeaker-room equalization system 200 utilizes 11 multi-tone-pink stimulus signals (generated via the stimuli determination unit 205) to simultaneously excite the 11 distinct loudspeakers.

Plot 650 is an estimated impulse response $\hat{h}_i(n)$ of loudspeaker i that is extracted after exciting loudspeaker i with a multi-tone-pink stimulus signal $x_i(n)$, plot 651 is a zoom-in of the plot 650, plot 652 is a true impulse response $h_i(n)$ of loudspeaker i, plot 653 is a zoom-in of the plot 652, and plot 654 is a reconstruction error e (n) (i.e., $h_1(n)-\hat{h}_i(n)$) for loudspeaker i.

FIG. 9B illustrates plots 660-664 for loudspeaker j, in one or more embodiments. A horizontal axis of each plot 660-663 represents sample index. A vertical axis of each plot 660-663 represents amplitude. A horizontal axis of plot 664 represents time in seconds (s). A vertical axis of plot 664 represents difference. Plot 660 is an estimated impulse response $\hat{h}_j(n)$ of loudspeaker j that is extracted after exciting loudspeaker j with another multi-tone-pink stimulus signal $x_j(n)$, plot 661 is a zoom-in of the plot 660, plot 662 is a true impulse response $h_j(n)$ of loudspeaker j, plot 663 is a zoom-in of the plot 662, and plot 664 is a reconstruction error $e_j(n)$ (i.e., $h_j(n)-\hat{h}_j(n)$) for loudspeaker j. The reconstruction errors $e_i(n)$ and $e_j(n)$ are substantially low.

In another embodiment, instead of cross-correlating techniques, the simultaneous deconvolution engine 230 applies one or more adaptive filtering techniques to simultaneously deconvolve the N loudspeaker-room impulse responses. Specifically, the simultaneous deconvolution engine 230 applies an adaptive filter such as, but not limited to, least mean squares (LMS), normalized LMS (NLMS), etc.

Conventionally, learning (i.e., adaptation) rates have to be manually tuned. By comparison, in one embodiment, the simultaneous deconvolution engine 230 is configured to determine optimal learning rates that ensure convergence of the adaptive filter to best possible estimates of loudspeaker-room impulse responses by applying a Bayesian optimization technique.

Let $\underline{w}_i(n)$ generally denote a LMS-derived, or NLMS-derived, finite impulse response (FIR) estimate of a loudspeaker channel i, wherein the under-bar represents a vector of L-taps, and $i \in [1, N]$. Let $\eta_i$ generally denote a learning rate corresponding to a LMS-derived, or NLMS-derived, FIR estimate $\underline{w}_i(n)$ of loudspeaker channel i. Applying the Bayesian optimization technique involves defining a plurality of hyper-parameters, and determining N optimal learning rates $\eta_i, \eta_i, \ldots$, and $\eta_N$ (i.e., Bayesian optimized learning rates) corresponding to the hyper-parameters in accordance with equations (20)-(24) provided below:

$$p_i(n)=\underline{w}_i^T(n-1)\underline{x}_i(n) \quad (20),$$

wherein the under-bar of $x_i(n)$ is a vector of L-lags, $$e_i(n)=y(n)-p_i(n) \quad (21), \text{ and}$$

$$\underline{w}_i(n)=\underline{w}_i(n-1)+\phi[x_i(n),e_i(n),\eta_i] \quad (22),$$

wherein, if the adaptive filter is LMS, $\phi[x_i(n), e_i(n),\eta_i]$ is expressed in accordance with equation (23) provided below:

$$\phi[x_i(n),e_i(n),\eta_i]=\eta_i e_i(n)\underline{x}_i(n) \quad (23),$$

wherein, if the adaptive filter is NLMS instead, $\phi[x_i(n), e_i(n),\eta_i]$ is expressed in accordance with equation (24) provided below:

$$\phi\left[\underline{x}_i(n),\ e_i(n),\ \eta_i\right] = \eta_i e_i(n)\frac{\underline{x}_i(n)}{\epsilon + \left\|\underline{x}_i(n)\right\|}, \quad (24)$$

wherein $\epsilon$ is a regularization parameter.

In one embodiment, the simultaneous deconvolution engine 230 is configured to perform magnitude-domain equalization of the N loudspeaker-room impulse responses by applying joint time-frequency smoothing to each LMS-derived, or NLMS-derived, FIR estimate of each loudspeaker channel i. For example, in one embodiment, complex domain smoothing is applied to N LMS-derived, or NLMS-derived, FIR estimates to obtain N ⅓-octave smoothed magnitude responses for the N loudspeaker channels.

Figure 10A:
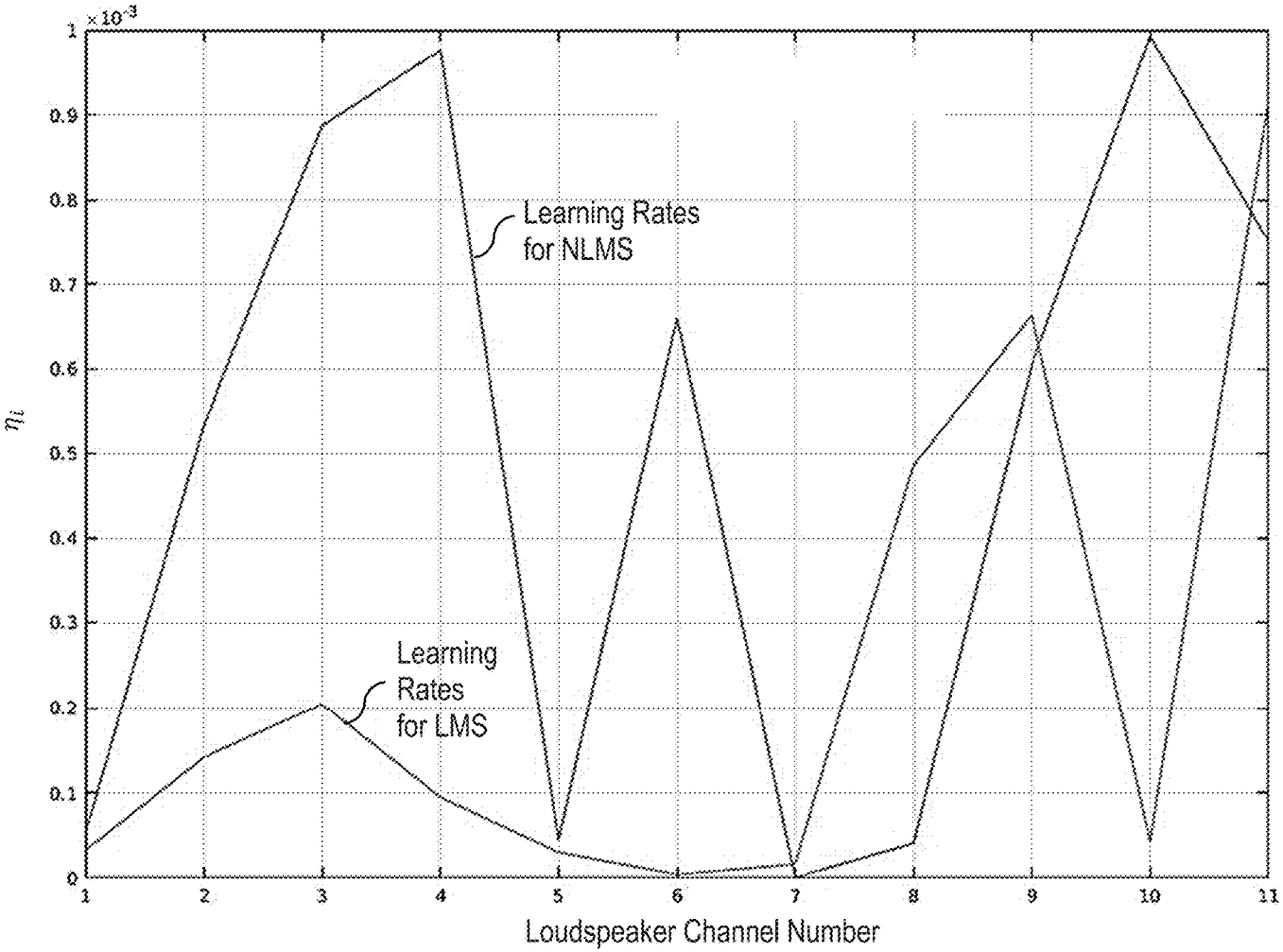
FIG. 10A illustrates a plot of Bayesian optimized learning rates, in one or more embodiments.

For FIGS. 10A-10D, assume an 11-loudspeaker setup (e.g., a 7.1.4 loudspeaker setup) comprising 11 distinct loudspeakers providing 11 loudspeaker channels. FIG. 10A illustrates a plot 700 of Bayesian optimized learning rates, in one or more embodiments. A horizontal axis of plot 700 represents loudspeaker channel number. A vertical axis of plot 700 represents learning rate. In one embodiment, the loudspeaker-room equalization system 200 determines 11 Bayesian optimized learning rates $\eta_1, \eta_2, \ldots$, and $\eta_{11}$ that ensure convergence of an adaptive filter (LMS or NLMS) to best possible estimates of loudspeaker-room impulse responses of the 11 loudspeaker channels.

Figure 10B:
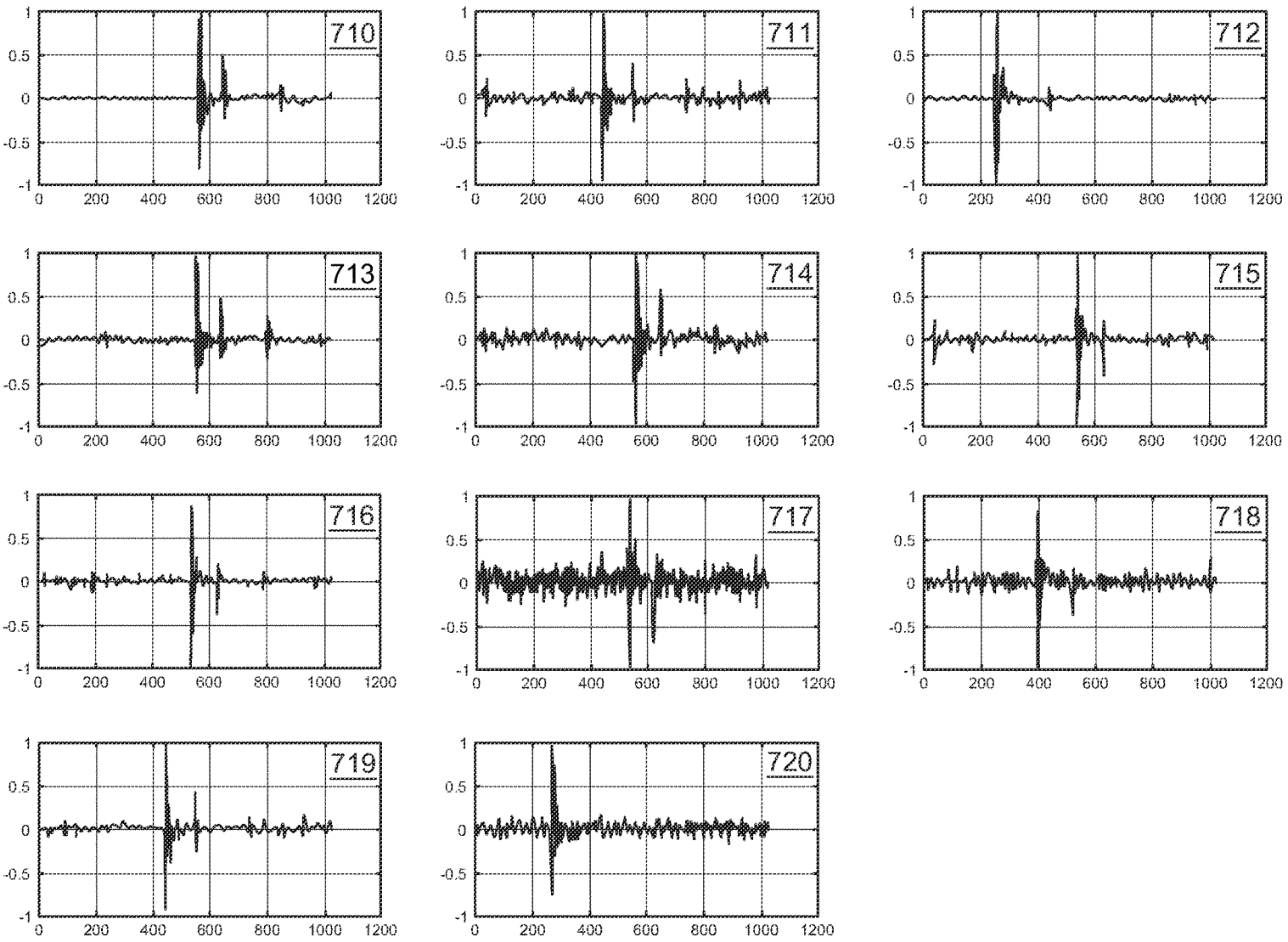
FIG. 10B illustrates zoomed-in plots comparing true impulse responses against estimated impulse responses that are determined utilizing least mean squares (LMS) as an adaptive filter, in one or more embodiments.

FIG. 10B illustrates zoomed-in plots 710-720 comparing true impulse responses against estimated impulse responses that are determined utilizing LMS as an adaptive filter, in one or more embodiments. A horizontal axis of each plot 710-720 represents time in seconds (s). A vertical axis of each plot 710-720 represents amplitude. In one embodiment, the loudspeaker-room equalization system 200, via the simultaneous deconvolution engine 230, utilizes LMS as an adaptive filter with Bayesian optimized learning rates $\eta_1, \eta_2, \ldots$, and $\eta_{11}$ of FIG. 10A to extract 11 LMS-derived estimated impulse responses.

Plot 710 compares a true impulse response $h_1(n)$ of a first loudspeaker channel against a LMS-derived estimated impulse response $\hat{h}_1(n)$ of the first loudspeaker channel, plot 711 compares a true impulse response $h_2(n)$ of a second loudspeaker channel against a LMS-derived estimated impulse response $\hat{h}_2(n)$ of the second loudspeaker channel, plot 712 compares a true impulse response $h_3(n)$ of a third loudspeaker channel against a LMS-derived estimated impulse response $\hat{h}_3(n)$ of the third loudspeaker channel, plot 713 compares a true impulse response $h_4(n)$ of a fourth loudspeaker channel against a LMS-derived estimated impulse response $\hat{h}_4(n)$ of the fourth loudspeaker channel, plot 714 compares a true impulse response $h_5(n)$ of a fifth loudspeaker channel against a LMS-derived estimated impulse response $\hat{h}_5(n)$ of the fifth loudspeaker channel, plot 715 compares a true impulse response $h_6(n)$ of a sixth loudspeaker channel against a LMS-derived estimated impulse response $\hat{h}_6(n)$ of the sixth loudspeaker channel, plot 716 compares a true impulse response $h_7(n)$ of a seventh loudspeaker channel against a LMS-derived estimated impulse response $\hat{h}_7(n)$ of the seventh loudspeaker channel, plot 717 compares a true impulse response $h_8(n)$ of an eighth loudspeaker channel against a LMS-derived estimated impulse response $\hat{h}_8(n)$ of the eighth loudspeaker channel, plot 718 compares a true impulse response $h_9(n)$ of a ninth loudspeaker channel against a LMS-derived estimated impulse response $\hat{h}_9(n)$ of the ninth loudspeaker channel, plot 719 compares a true impulse response $h_{10}(n)$ of a tenth loudspeaker channel against a LMS-derived estimated impulse response $\hat{h}_{10}(n)$ of the tenth loudspeaker channel, and plot 720 compares a true impulse response $h_{11}(n)$ of an eleventh loudspeaker channel against a LMS-derived estimated impulse response $\hat{h}_{11}(n)$ of the eleventh loudspeaker channel.

Figure 10C:
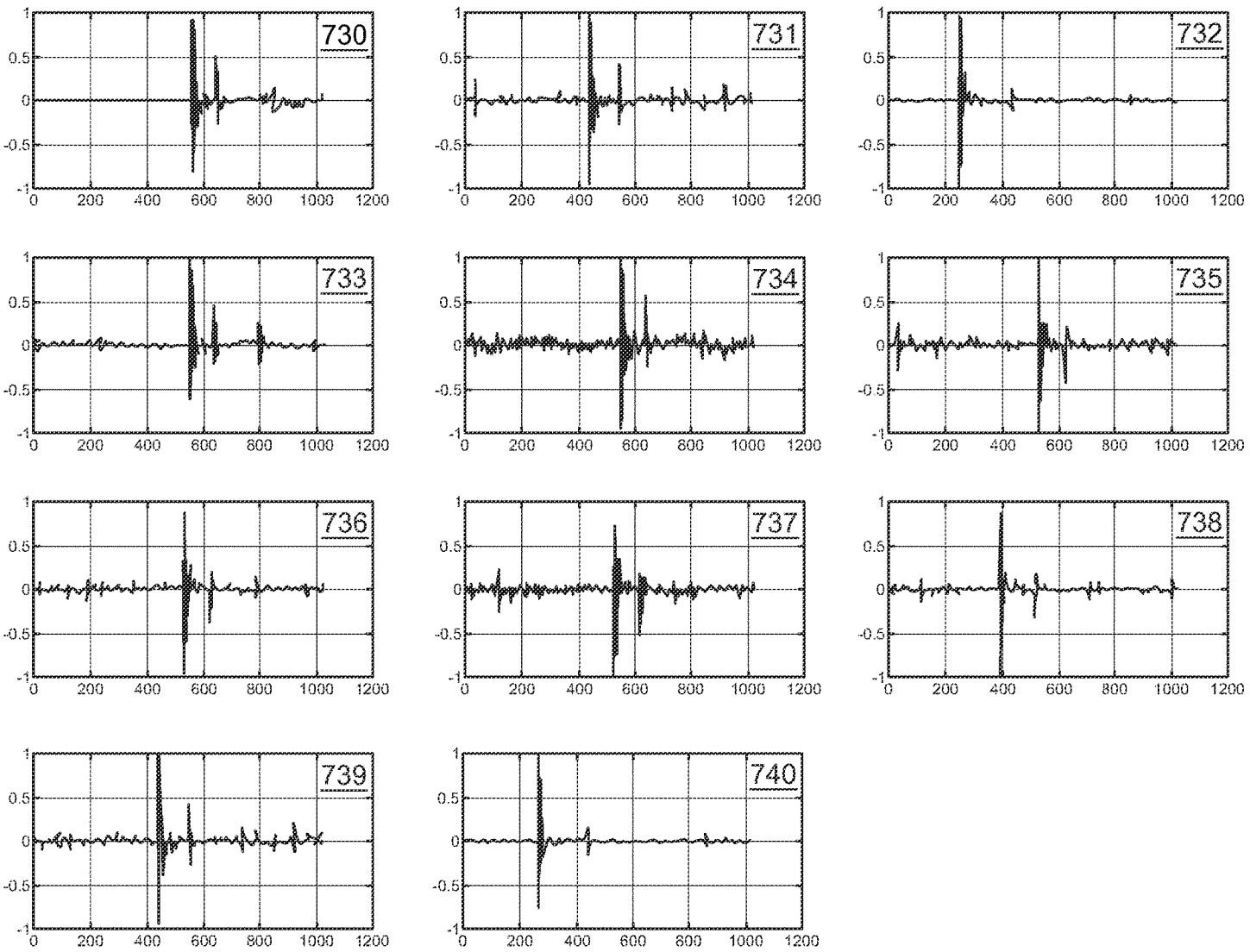
FIG. 10C illustrates zoomed-in plots comparing true impulse responses against estimated impulse responses that are determined utilizing normalized LMS (NLMS) as an adaptive filter, in one or more embodiments.

FIG. 10C illustrates zoomed-in plots 730-740 comparing true impulse responses against estimated impulse responses that are determined utilizing NLMS as an adaptive filter, in one or more embodiments. A horizontal axis of each plot 730-740 represents time in seconds (s). A vertical axis of each plot 730-740 represents amplitude. In one embodiment, the loudspeaker-room equalization system 200, via the simultaneous deconvolution engine 230, utilizes NLMS as an adaptive filter with Bayesian optimized learning rates $\eta_1$, $\eta_2$, . . . , and $\eta_{11}$ of FIG. 10A to extract 11 NLMS-derived estimated impulse responses.

Plot 730 compares a true impulse response $h_1(n)$ of a first loudspeaker channel against a NLMS-derived estimated impulse response $\hat{h}_1(n)$ of the first loudspeaker channel, plot 731 compares a true impulse response $h_2(n)$ of a second loudspeaker channel against a NLMS-derived estimated impulse response $\hat{h}_2(n)$ of the second loudspeaker channel, plot 732 compares a true impulse response $h_3(n)$ of a third loudspeaker channel against a NLMS-derived estimated impulse response $\hat{h}_3(n)$ of the third loudspeaker channel, plot 733 compares a true impulse response $h_4(n)$ of a fourth loudspeaker channel against a NLMS-derived estimated impulse response $\hat{h}_4(n)$ of the fourth loudspeaker channel, plot 734 compares a true impulse response $h_5(n)$ of a fifth loudspeaker channel against a NLMS-derived estimated impulse response $\hat{h}_5(n)$ of the fifth loudspeaker channel, plot 735 compares a true impulse response $h_6(n)$ of a sixth loudspeaker channel against a NLMS-derived estimated impulse response $\hat{h}_6(n)$ of the sixth loudspeaker channel, plot 736 compares a true impulse response $h_7(n)$ of a seventh loudspeaker channel against a NLMS-derived estimated impulse response $\hat{h}_7(n)$ of the seventh loudspeaker channel, plot 737 compares a true impulse response $h_8(n)$ of an eighth loudspeaker channel against a NLMS-derived estimated impulse response $\hat{h}_8(n)$ of the eighth loudspeaker channel, plot 738 compares a true impulse response $h_9(n)$ of a ninth loudspeaker channel against a NLMS-derived estimated impulse response $\hat{h}_9(n)$ of the ninth loudspeaker channel, plot 739 compares a true impulse response $h_{10}(n)$ of a tenth loudspeaker channel against a NLMS-derived estimated impulse response $\hat{h}_{10}(n)$ of the tenth loudspeaker channel, and plot 740 compares a true impulse response $h_{11}(n)$ of an eleventh loudspeaker channel against a NLMS-derived estimated impulse response $\hat{h}_{11}(n)$ of the eleventh loudspeaker channel.

Figure 10D:
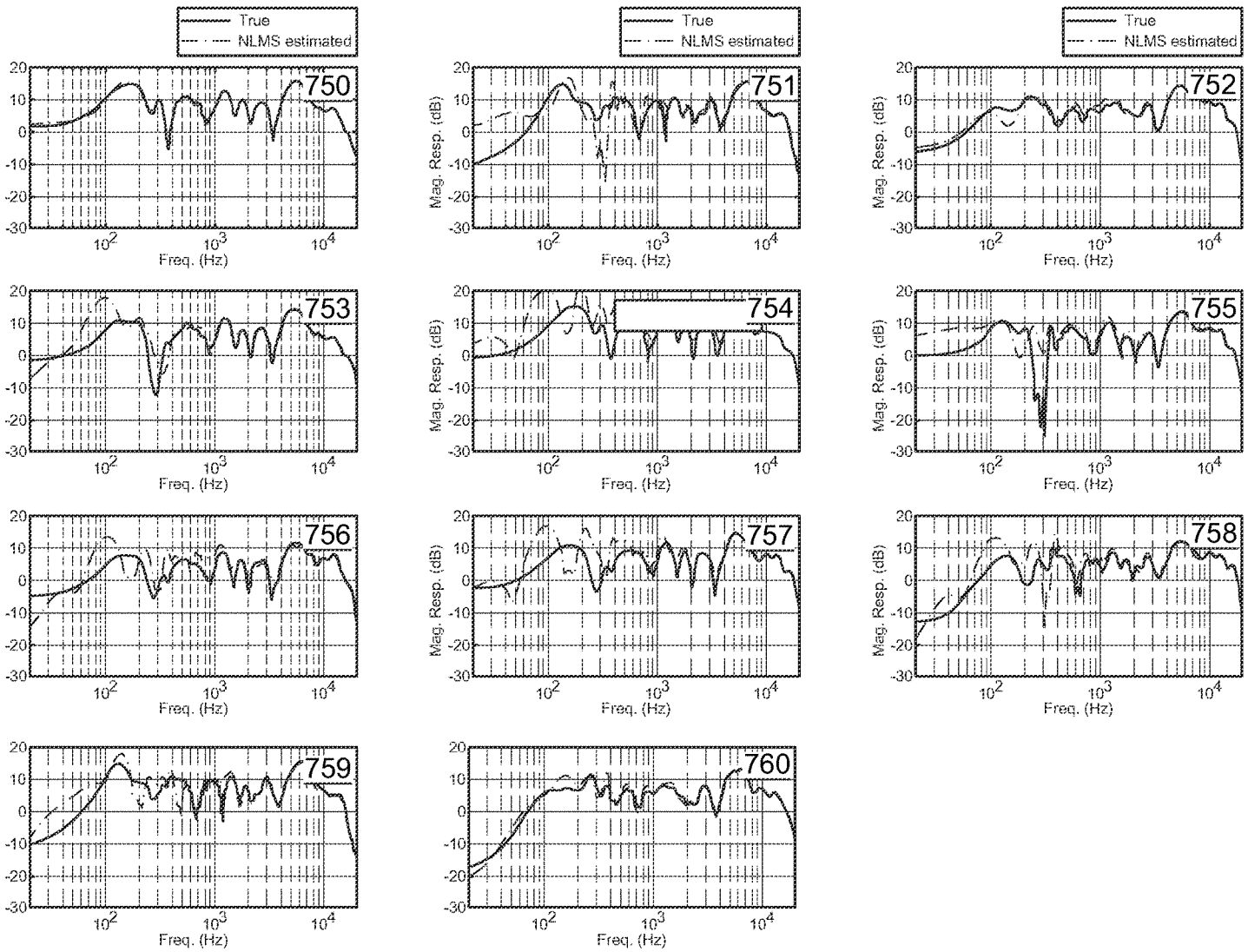
FIG. 10D illustrates zoomed-in plots comparing true impulse responses against smoothed magnitude responses of NLMS-derived FIR estimates, in one or more embodiments.

FIG. 10D illustrates zoomed-in plots 750-760 comparing true impulse responses against smoothed magnitude responses of NLMS-derived FIR estimates, in one or more embodiments. A horizontal axis of each plot 750-760 represents time in seconds (s). A vertical axis of each plot 750-760 represents magnitude response in decibels (dB). In one embodiment, the loudspeaker-room equalization system 200, via the simultaneous deconvolution engine 230, applies complex domain smoothing to the 11 NLMS-derived estimated impulse responses of FIG. 10C to obtain 11⅓-octave smoothed magnitude responses. Plot 750 compares a true impulse response $h_1(n)$ of a first loudspeaker channel against a ⅓-octave smoothed magnitude response of the NLMS-derived estimated impulse response $\hat{h}_1(n)$ of the first loudspeaker channel, plot 751 compares a true impulse response $h_2(n)$ of a second loudspeaker channel against a ⅓-octave smoothed magnitude response of the NLMS-derived estimated impulse response $\hat{h}_2(n)$ of the second loudspeaker channel, plot 752 compares a true impulse response $h_3(n)$ of a third loudspeaker channel against a ⅓-octave smoothed magnitude response of the NLMS-derived estimated impulse response $\hat{h}_3(n)$ of the third loudspeaker channel, plot 753 compares a true impulse response $h_4(n)$ of a fourth loudspeaker channel against a ⅓-octave smoothed magnitude response of the NLMS-derived estimated impulse response $\hat{h}_4(n)$ of the fourth loudspeaker channel, plot 754 compares a true impulse response $h_5(n)$ of a fifth loudspeaker channel against a ⅓-octave smoothed magnitude response of the NLMS-derived estimated impulse response $\hat{h}_5(n)$ of the fifth loudspeaker channel, plot 755 compares a true impulse response $h_6(n)$ of a sixth loudspeaker channel against a ⅓-octave smoothed magnitude response of the NLMS-derived estimated impulse response $\hat{h}_6(n)$ of the sixth loudspeaker channel, plot 756 compares a true impulse response $h_7(n)$ of a seventh loudspeaker channel against a ⅓-octave smoothed magnitude response of the NLMS-derived estimated impulse response $\hat{h}_7(n)$ of the seventh loudspeaker channel, plot 757 compares a true impulse response $h_8(n)$ of an eighth loudspeaker channel against a ⅓-octave smoothed magnitude response of the NLMS-derived estimated impulse response $\hat{h}_8(n)$ of the eighth loudspeaker channel, plot 758 compares a true impulse response $h_9(n)$ of a ninth loudspeaker channel against a ⅓-octave smoothed magnitude response of the NLMS-derived estimated impulse response $\hat{h}_9(n)$ of the ninth loudspeaker channel, plot 759 compares a true impulse response $h_{10}(n)$ of a tenth loudspeaker channel against a ⅓-octave smoothed magnitude response of the NLMS-derived estimated impulse response $\hat{h}_{10}(n)$ of the tenth loudspeaker channel, and plot 760 compares a true impulse response $h_{11}(n)$ of an eleventh loudspeaker channel against a ⅓-octave smoothed magnitude response of the NLMS-derived estimated impulse response $\hat{h}_{11}(n)$ of the eleventh loudspeaker channel.

Figure 11:
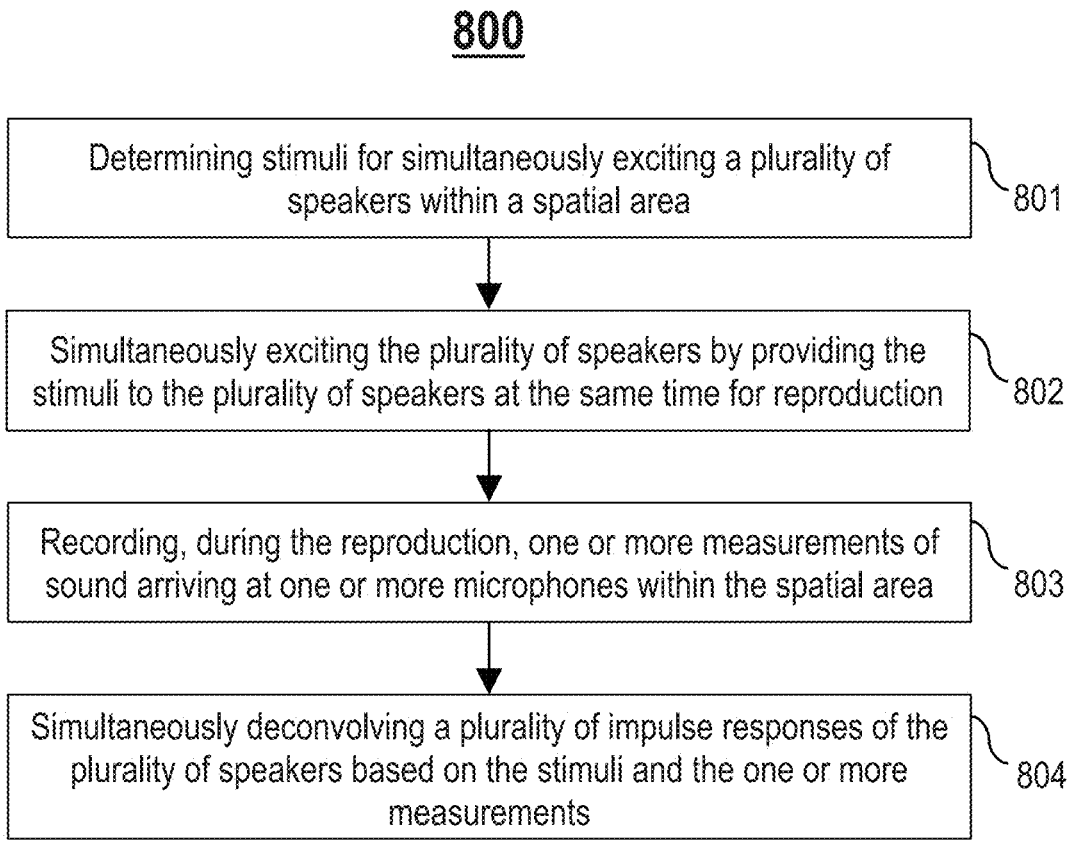
FIG. 11 is a flowchart of an example process for loudspeaker-room equalization with simultaneous deconvolution of loudspeaker-room impulse responses, in one or more embodiments.

FIG. 11 is a flowchart of an example process 800 for loudspeaker-room equalization with simultaneous deconvolution of loudspeaker-room impulse responses, in one or more embodiments. Process block 801 includes determining stimuli for simultaneously exciting a plurality of speakers within a spatial area. Process block 802 includes simultaneously exciting the plurality of speakers by providing the stimuli to the plurality of speakers at the same time for reproduction. Process block 803 includes recording, during the reproduction, one or more measurements of sound arriving at one or more microphones within the spatial area. Process block 804 includes simultaneously deconvolving a plurality of impulse responses of the plurality of speakers based on the stimuli and the one or more measurements.

In one embodiment, process blocks 801-804 may be performed by one or more components of the loudspeaker-room equalization system 130 or 200.

Figure 12:
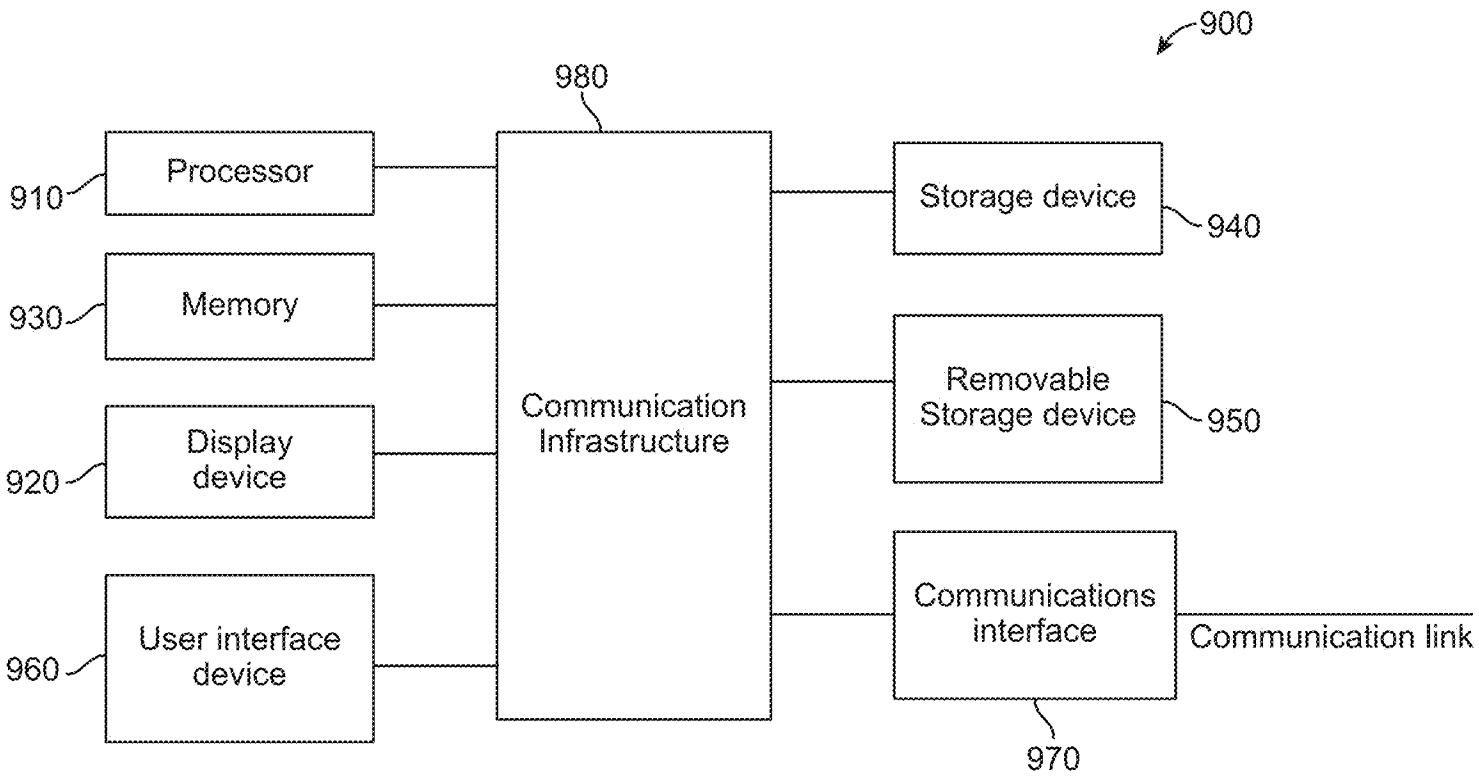
FIG. 12 is a high-level block diagram showing an information processing system comprising a computer system useful for implementing the disclosed embodiments.

FIG. 12 is a high-level block diagram showing an information processing system comprising a computer system 900 useful for implementing the disclosed embodiments. The systems 130 and 200 may be incorporated in the computer system 900. The computer system 900 includes one or more processors 910, and can further include an electronic display device 920 (for displaying video, graphics, text, and other data), a main memory 930 (e.g., random access memory (RAM)), storage device 940 (e.g., hard disk drive), removable storage device 950 (e.g., removable storage drive, removable memory module, a magnetic tape drive, optical disk drive, computer readable medium having stored therein computer software and/or data), viewer interface device 960 (e.g., keyboard, touch screen, keypad, pointing device), and a communication interface 970 (e.g., modem, a network interface (such as an Ethernet card), a communications port, or a PCMCIA slot and card). The communication interface 970 allows software and data to be transferred between the computer system and external devices. The system 900 further includes a communications infrastructure 980 (e.g., a communications bus, cross-over bar, or network) to which the aforementioned devices/modules 910 through 970 are connected.

Information transferred via communications interface 970 may be in the form of signals such as electronic, electromagnetic, optical, or other signals capable of being received by communications interface 970, via a communication link that carries signals and may be implemented using wire or cable, fiber optics, a phone line, a cellular phone link, a radio frequency (RF) link, and/or other communication channels. Computer program instructions representing the block diagram and/or flowcharts herein may be loaded onto a computer, programmable data processing apparatus, or processing devices to cause a series of operations performed thereon to generate a computer implemented process. In one embodiment, processing instructions for process 800 (FIG. 11) may be stored as program instructions on the memory 930, storage device 940, and/or the removable storage device 950 for execution by the processor 910.

Embodiments have been described with reference to flowchart illustrations and/or block diagrams of methods, apparatus (systems) and computer program products. Each block of such illustrations/diagrams, or combinations thereof, can be implemented by computer program instructions. The computer program instructions when provided to a processor produce a machine, such that the instructions, which execute via the processor create means for implementing the functions/operations specified in the flowchart and/or block diagram. Each block in the flowchart/block diagrams may represent a hardware and/or software module or logic. In alternative implementations, the functions noted in the blocks may occur out of the order noted in the figures, concurrently, etc.

The terms "computer program medium," "computer usable medium," "computer readable medium", and "computer program product," are used to generally refer to media such as main memory, secondary memory, removable storage drive, a hard disk installed in hard disk drive, and signals. These computer program products are means for providing software to the computer system. The computer readable medium allows the computer system to read data, instructions, messages or message packets, and other computer readable information from the computer readable medium. The computer readable medium, for example, may include non-volatile memory, such as a floppy disk, ROM, flash memory, disk drive memory, a CD-ROM, and other permanent storage. It is useful, for example, for transporting information, such as data and computer instructions, between computer systems. Computer program instructions may be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks.

As will be appreciated by one skilled in the art, aspects of the embodiments may be embodied as a system, method or computer program product. Accordingly, aspects of the embodiments may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, aspects of the embodiments may take the form of a computer program product embodied in one or more computer readable medium(s) having computer readable program code embodied thereon.

Any combination of one or more computer readable medium(s) may be utilized. The computer readable medium may be a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

Computer program code for carrying out operations for aspects of one or more embodiments may be written in any combination of one or more programming languages, including an object oriented programming language such as Java, Smalltalk, C++ or the like and conventional procedural programming languages, such as the "C" programming language or similar programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

Aspects of one or more embodiments are described above with reference to flowchart illustrations and/or block diagrams of methods, apparatus (systems) and computer program products. It will be understood that each block of the flowchart illustrations and/or block diagrams, and combinations of blocks in the flowchart illustrations and/or block diagrams, can be implemented by computer program instructions. These computer program instructions may be provided to a special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks.

The computer program instructions may also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified in the flowchart and/or block diagram block or blocks.

The flowchart and block diagrams in the Figures illustrate the architecture, functionality, and operation of possible implementations of systems, methods, and computer program products according to various embodiments. In this regard, each block in the flowchart or block diagrams may represent a module, segment, or portion of instructions, which comprises one or more executable instructions for implementing the specified logical function(s). In some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

References in the claims to an element in the singular is not intended to mean "one and only" unless explicitly so stated, but rather "one or more." All structural and functional equivalents to the elements of the above-described exemplary embodiment that are currently known or later come to be known to those of ordinary skill in the art are intended to be encompassed by the present claims. No claim element herein is to be construed under the provisions of 35 U.S.C. section 112, sixth paragraph, unless the element is expressly recited using the phrase "means for" or "step for."

The terminology used herein is for the purpose of describing particular embodiments only and is not intended to be limiting of the disclosed technology. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the embodiments has been presented for purposes of illustration and description, but is not intended to be exhaustive or limited to the embodiments in the form disclosed. Many modifications and variations will be apparent to those of ordinary skill in the art without departing from the scope and spirit of the disclosed technology.

Though the embodiments have been described with reference to certain versions thereof; however, other versions are possible. Therefore, the spirit and scope of the appended claims should not be limited to the description of the preferred versions contained herein.

What is claimed is:

1. A method comprising:

determining stimuli for simultaneously exciting a plurality of speakers within a spatial area, wherein the stimuli comprises a plurality of stimulus signals, and each of the plurality of stimulus signals is circularly shifted relative to another of the plurality of stimulus signals by an amount based on a pre-determined number of samples;

simultaneously exciting the plurality of speakers by providing the stimuli to the plurality of speakers at the same time for reproduction, wherein each of the plurality of speakers reproduces a different stimulus signal of the plurality of stimulus signals during the reproduction;

recording, during the reproduction, one or more measurements of sound arriving at one or more microphones within the spatial area; and simultaneously deconvolving a plurality of impulse responses of the plurality of speakers based on the stimuli and the one or more measurements.

2. The method of claim 1, further comprising:

for each of the plurality of speakers:

providing the speaker with a stimulus signal of the plurality of stimulus signals to playback at the speaker from; and processing the playback at the speaker based on the stimulus signal.

3. The method of claim 1, further comprising:

simultaneously extracting the plurality of impulse responses from the one or more measurements by applying a simultaneous extraction routine to the one or more measurements, wherein the simultaneous extraction routine is based on the stimuli.

4. The method of claim 1, wherein each of the plurality of stimulus signals satisfies a Kronecker delta function.

5. The method of claim 1, wherein the one or more measurements capture reverberation of an arbitrary duration.

6. The method of claim 1, further comprising:

for each speaker channel of the plurality of speakers, applying a pre-emphasis filter to the speaker channel before the one or more measurements are recorded.

7. The method of claim 6, wherein each pre-emphasis filter applied is randomly generated.

8. The method of claim 6, wherein each pre-emphasis filter applied is pre-designed.

9. The method of claim 1, wherein the stimuli is one of a Maximum Length Sequence (MLS) stimuli, a logarithmic sweep stimuli, a multi-tone stimuli, or a shaped stimuli.

10. A system comprising:

at least one processor; and a non-transitory processor-readable memory device storing instructions that when executed by the at least one processor causes the at least one processor to perform operations including:

determining stimuli for simultaneously exciting a plurality of speakers within a spatial area, wherein the stimuli comprises a plurality of stimulus signals, and each of the plurality of stimulus signals is circularly shifted relative to another of the plurality of stimulus signals by an amount based on a pre-determined number of samples;

simultaneously exciting the plurality of speakers by providing the stimuli to the plurality of speakers at the same time for reproduction, wherein each of the plurality of speakers reproduces a different stimulus signal of the plurality of stimulus signals during the reproduction;

recording, during the reproduction, one or more measurements of sound arriving at one or more microphones within the spatial area; and simultaneously deconvolving a plurality of impulse responses of the plurality of speakers based on the stimuli and the one or more measurements.

11. The system of claim 10, wherein the operations further include:

for each of the plurality of speakers:

providing the speaker with a stimulus signal of the plurality of stimulus signals to playback at the speaker; and processing the playback at the speaker based on the stimulus signal.

12. The system of claim 10, wherein the operations further include:

simultaneously extracting the plurality of impulse responses from the one or more measurements by applying a simultaneous extraction routine to the one or more measurements, wherein the simultaneous extraction routine is based on the stimuli.

13. The system of claim 10, wherein the each of the plurality of stimulus signals satisfies a Kronecker delta function.

14. The system of claim 10, wherein the one or more measurements capture reverberation of an arbitrary duration.

15. The system of claim 10, wherein the operations further include:

for each speaker channel of the plurality of speakers, applying a pre-emphasis filter to the speaker channel before the one or more measurements are recorded.

16. The system of claim 15, wherein each pre-emphasis filter applied is randomly generated.

17. The system of claim 15, wherein each pre-emphasis filter applied is pre-designed.

18. The system of claim 10, wherein the stimuli is one of a Maximum Length Sequence (MLS) stimuli, a logarithmic sweep stimuli, a multi-tone stimuli, or a shaped stimuli.

19. A non-transitory processor-readable medium that includes a program that when executed by a processor performs a method, the method comprising:

determining stimuli for simultaneously exciting a plurality of speakers within a spatial area, wherein the stimuli comprises a plurality of stimulus signals, and each of the plurality of stimulus signals is circularly shifted relative to another of the plurality of stimulus signals by an amount based on a pre-determined number of samples;

simultaneously exciting the plurality of speakers by providing the stimuli to the plurality of speakers at the same time for reproduction, wherein each of the plurality of speakers reproduces a different stimulus signal of the plurality of stimulus signals during the reproduction;

recording, during the reproduction, one or more measurements of sound arriving at one or more microphones within the spatial area; and simultaneously deconvolving a plurality of impulse responses of the plurality of speakers based on the stimuli and the one or more measurements.

20. The non-transitory processor-readable medium of claim 19, wherein the method further comprises:

for each of the plurality of speakers:

providing the speaker with a stimulus signal of the plurality of stimulus signals to playback at the speaker; and processing the playback at the speaker based on the stimulus signal.

* * * * *